US008798502B2

(12) United States Patent
Sato

(10) Patent No.: US 8,798,502 B2
(45) **Date of Patent: *Aug. 5, 2014**

(54) IMAGE FORMING APPARATUS HAVING TONER CARTRIDGE INCLUDING FIRST AND SECOND CONTAINING UNITS, ONE OF WHICH IS CONFIGURED TO CONTAIN COLLECTED WASTE TONER

(71) Applicant: Brother Kogyo Kabushiki Kaisha, Nagoya (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/906,640

(22) Filed: May 31, 2013

(65) Prior Publication Data

US 2013/0266341 A1 Oct. 10, 2013

Related U.S. Application Data

(63) Continuation of application No. 13/331,605, filed on Dec. 20, 2011, now Pat. No. 8,463,160, which is a continuation of application No. 12/182,242, filed on Jul. 30, 2008, now Pat. No. 8,103,187.

(30) Foreign Application Priority Data

Jul. 31, 2007 (JP) ..... 2007-199949

(51) Int. Cl.
*G03G 15/08* (2006.01)

(52) U.S. Cl.
USPC ..... 399/120; 399/358; 399/360

(58) Field of Classification Search
USPC ..... 399/119, 120, 358–360
See application file for complete search history.

(56) References Cited

U.S. PATENT DOCUMENTS 5,933,690 A 8/1999 Sugimoto et al.
6,801,742 B1 10/2004 Mochimaru et al.

(Continued)

FOREIGN PATENT DOCUMENTS

CN 1450417 A 10/2003
JP 08-110691 A 4/1996

(Continued)

OTHER PUBLICATIONS

Chinese Office Action issued in corresponding Chinese Application No. 200810144284.6, mailed Jan. 8, 2010.

*Primary Examiner* — David Gray
*Assistant Examiner* — Laura Roth
(74) *Attorney, Agent, or Firm* — Banner & Witcoff, Ltd.

(57) ABSTRACT

An image forming apparatus includes a housing; a partition wall which is provided in the housing along a substantially vertical direction, the partition wall partitioning an inner space of the housing into a first space and a second space; developing units which are disposed in parallel along the substantially vertical direction in the first space, each of the developing units comprising a first reception opening and a return opening; and developer cartridges which correspond to the plurality of developing units, the developer cartridges being disposed in parallel along the substantially vertical direction in the second space, each of developer cartridges comprising a supply opening and a second reception opening. The first reception openings of the developing units communicate with the supply openings of respective ones of the developer cartridges, and the return openings of the developer units communicate with the second reception openings of respective ones of the developer cartridges.

11 Claims, 12 Drawing Sheets

(56) References Cited

U.S. PATENT DOCUMENTS

| | | | | |
|---|---|---|---|---|
| 7,031,637 | B2 | 4/2006 | Fujita | |
| 7,251,434 | B2 | 7/2007 | Ikeda et al. | |
| 7,477,863 | B2 | 1/2009 | Watanabe et al. | |
| 8,086,138 | B2 | 12/2011 | Sato | |
| 8,103,187 | B2 * | 1/2012 | Sato | 399/120 |
| 8,254,797 | B2 | 8/2012 | Sato | |
| 8,463,160 | B2 * | 6/2013 | Sato | 399/120 |
| 2003/0185589 | A1 * | 10/2003 | Fujita | |
| 2004/0009009 | A1 | 1/2004 | Beaufort | |
| 2004/0022556 | A1 | 2/2004 | Nomura | |
| 2008/0080902 | A1 | 4/2008 | Saito et al. | |
| 2008/0286014 | A1 | 11/2008 | Saito et al. | |
| 2009/0324284 | A1 | 12/2009 | Ohta | |
| 2010/0054815 | A1 | 3/2010 | Okimura et al. | |

FOREIGN PATENT DOCUMENTS

| | | | |
|---|---|---|---|
| JP | 2002-311669 | A | 10/2002 |
| JP | 2003084556 | A | 3/2003 |
| JP | 2003295562 | A | 10/2003 |
| JP | 3880429 | B2 | 11/2006 |

* cited by examiner

IMAGE FORMING APPARATUS HAVING TONER CARTRIDGE INCLUDING FIRST AND SECOND CONTAINING UNITS, ONE OF WHICH IS CONFIGURED TO CONTAIN COLLECTED WASTE TONER

CROSS REFERENCE TO RELATED APPLICATION

The present application is a continuation of co-pending U.S. application Ser. No. 13/331,605, filed Dec. 20, 2011, which is a continuation of U.S. application Ser. No. 12/182,242, filed Jul. 30, 2008, now U.S. Pat. No. 8,103,187B2, issued Jan. 24, 2012, which claims priority from Japanese Patent Application No. 2007-199949, which was filed on Jul. 31, 2007, the disclosures of which are herein incorporated by reference in their entirety.

TECHNICAL FIELD

Apparatuses and devices consistent with the present invention relate to image forming apparatuses and, more particularly, to image forming apparatuses such as a color laser printer.

BACKGROUND

Japanese unexamined patent application No. JP-A-2003-295562 describes a related art image forming apparatus such as a color printer. The related art image forming apparatus includes a plurality of process cartridges each having a photosensitive drum and a plurality of developer supply units each containing developer to be supplied to the process cartridge. The process cartridge and the developer supply unit can be attached to and detached from a printer main body along the same direction. The developer contained in each of the developer supply units is supplied from a developer discharge port to a developer reception port of the corresponding process cartridge.

SUMMARY

In the related art image forming apparatus, the developer discharge port of each of the developer supply units is adjacently disposed above the developer reception port of the corresponding process cartridge. That is, each of the developer supply units overlaps with the corresponding process cartridge from above.

The related art configuration creates some disadvantages. For example, in the case where one of the developer supply unit and the process cartridge is mounted to the printer main body and the other is attached to or detached from the printer main body, the developer supply unit and the process cartridge might be caught by each other in the developer discharge port and the developer reception port where they overlap with each other, and smooth attachment and detachment becomes difficult. Further, since the developer discharge port is adjacently disposed above the developer reception port, at the time of attachment or detachment of the developer supply unit, the developer might leak and drop from the developer discharge port, and the developer supply unit and the process cartridge might be stained by the developer.

Accordingly, it is an aspect of the present invention to provide an image forming apparatus in which a developing unit and a developer cartridge can be singly attached to and detached from a housing without leakage of developer.

According to an illustrative aspect of the present invention, there is provided an image forming apparatus comprising: a housing; a plurality of developing units which are disposed in parallel along a substantially vertical direction in the housing, each of the developing units comprising an image carrier on which an electrostatic latent image is formed, a developer carrier which carries developer for supplying the developer to the image carrier and visualizing the electrostatic latent image to form a developer image, and a developing unit side reception opening for receiving the developer; and a plurality of developer cartridges which correspond to the plurality of developing units, each of the developer cartridges containing the developer to be supplied to a respective one of the plurality of the developer carriers, the developer cartridges being disposed in parallel along the substantially vertical direction in the housing, each of developer cartridges comprising a cartridge side supply opening through which the developer passes to the respective developer carrier; wherein the developing units and the developer cartridges can be independently attached to and detached from the housing, each of the developer cartridges is disposed to be opposite to an end of a respective one of the developing units along a substantially horizontal direction in a longitudinal direction of the developer carrier, and wherein the cartridge side supply opening and the developing unit side reception opening are disposed to be opposite to each other along the substantially horizontal direction.

According to another illustrative aspect of the present invention, there is provided an image forming apparatus comprising: a housing; a partition wall which is provided in the housing along a substantially vertical direction, the partition wall partitioning an inner space of the housing into a first space and a second space; a plurality of developing units which are disposed in parallel along the substantially vertical direction in the first space, each of the developing units comprising an image carrier which is supported by the partition wall and on which an electrostatic latent image is formed, and a developer carrier which carries a developer for supplying the developer to the image carrier and visualizing an electrostatic latent image to form a developer image; and a plurality of developer cartridges which correspond to the plurality of developing units, the developer cartridges containing the developer to be supplied to respective ones of the developer carriers, the developer cartridges being disposed in parallel along the substantially vertical direction in the second space, wherein each of the developer cartridges comprises a cartridge side supply opening, which is disposed above a lower edge thereof, for allowing passage of the developer supplied to the developer carrier.

According to another illustrative aspect of the present invention, there is provided An image forming apparatus comprising: a housing; a partition wall which is provided in the housing along a substantially vertical direction, the partition wall partitioning an inner space of the housing into a first space and a second space; a plurality of developing units which are disposed in parallel along the substantially vertical direction in the first space, each of the developing units comprising a first reception opening and a return opening; and a plurality of developer cartridges which correspond to the plurality of developing units, the developer cartridges being disposed in parallel along the substantially vertical direction in the second space, each of developer cartridges comprising a supply opening and a second reception opening, wherein the first reception openings of the developing units communicate with the supply openings of respective ones of the developer cartridges, and the return openings of the developer units communicate with the second reception openings of respective ones of the developer cartridges.

BRIEF DESCRIPTION OF THE DRAWINGS

Illustrative aspects of the invention will be described in detail with reference to the following figures wherein:

FIGS. 8A and 8B are right front side perspective views of the toner cartridge of the printer of FIG. 1 in which FIG. 8A shows a state of the toner cartridge in which an inner cylinder is at a closed position, and FIG. 8B shows a state of the toner cartridge in which the inner cylinder is at an open position;

FIGS. 9A and 9B are left rear side perspective views of the toner cartridge of FIGS. 8A and 8B, respectively, in which FIG. 9A shows a state of the toner cartridge in which the inner cylinder is at the closed position, and FIG. 9B shows a state of the toner cartridge in which the inner cylinder is at the open position;

FIGS. 10A and 10B are right side sectional views of toner cartridges of the printer of FIG. 1 in which FIG. 10A shows a black toner cartridge, and FIG. 10B shows a toner cartridge other than the black;

FIG. 11A shows a state in which the inner cylinder is at the closed position, and FIG. 11B shows a state in which the inner cylinder is at the open position; FIG. 12A shows a state of the toner cartridge in which the body shutter is at a closed position, and FIG. 12B shows a state of the toner cartridge in which the body shutter is at an open position.

DETAILED DESCRIPTION OF EXEMPLARY EMBODIMENTS OF THE PRESENT INVENTION

1. Structure of the Printer

Figure 1:
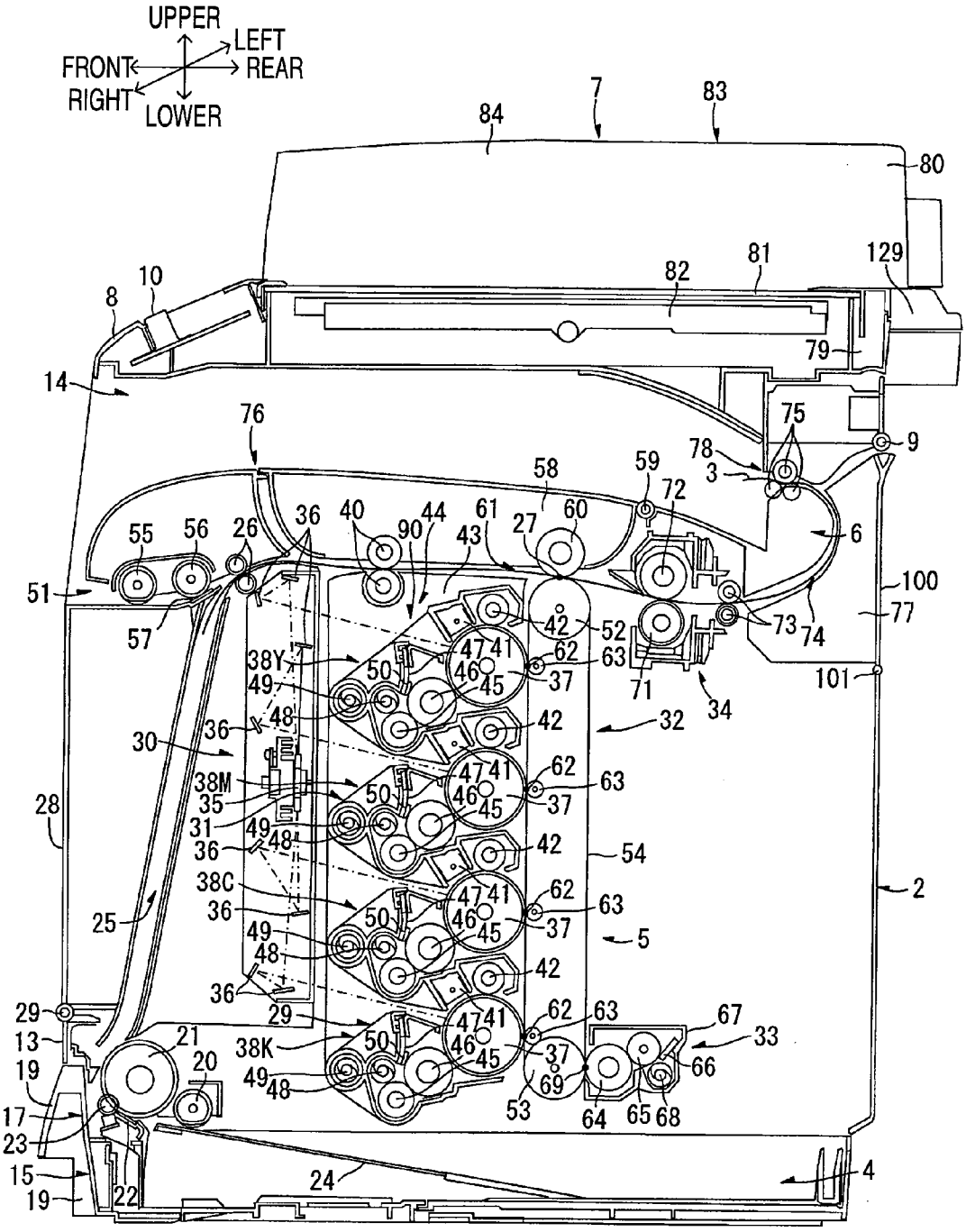
FIG. 1 is a right side sectional view showing a printer according to an exemplary embodiment of the present invention.

FIG. 1 is a right side sectional view showing a printer according to an exemplary embodiment of the present invention.

As shown in FIG. 1, the printer is embodied as a vertically-disposed-type tandem color laser printer in which a plurality of drum units 38 are disposed in parallel along a substantially vertical direction. The printer 1 includes, in a box-shaped main body casing 2 as an example of a housing, a sheet feeding unit 4 to feed a sheet 3, an image forming unit 5 for forming an image on the fed sheet 3, and a sheet discharging unit 6 for discharging the sheet 3 on which the image is formed. The printer 1 further includes a reading scanner unit 7 that is provided above the main body casing 2 and is for reading image information of an original document, and is constructed as a so-called multi functional device.

Incidentally, in the following description, in a state in which a toner cartridge 39, and the drum units 38 are mounted to the main body casing 2, the left side on the paper of FIG. 1 is the front (forward) side, and the right side on the paper of FIG. 1 is the back (rear) side. A front side in the paper thickness direction of FIG. 1 is the right side, and the depth side in the paper thickness direction of FIG. 1 is the left side. Incidentally, the right-left direction is sometimes called the width direction. The front-rear direction and the right-left direction are included in the substantially horizontal direction and are directions orthogonal to each other, and the up-down direction is included in the substantially vertical direction.

(1) Main Body Casing

The main body casing 2 is long in the up-down direction.

An upper side wall 8 of the main body casing 2 is provided to be capable of swinging with respect to the main body casing 2. In more detail, a swing shaft 9 of the upper side wall 8 extends in the width direction at the rear side of upper end of the main body casing 2, and the upper side wall 8 swings between a closed position (see FIG. 1) in which the upper side wall 8 falls and closes the upper surface of the main body casing 2, and an open position (see FIG. 3) in which the upper side wall 8 rises and opens the upper surface of the main body casing 2 upward. Incidentally, when the upper side wall 8 is at the open position, the inside (particularly, an after-mentioned first swing wall 58) of the main body casing is exposed upward from the upper surface of the main body casing 2. The reading scanner unit 7 is provided on the upper surface of the upper side wall 8, and swings together with the upper side wall 8. The front side portion of the upper side wall 8 is inclined forward and downward, and an operation panel 10 is provided on this portion.

Figure 4:
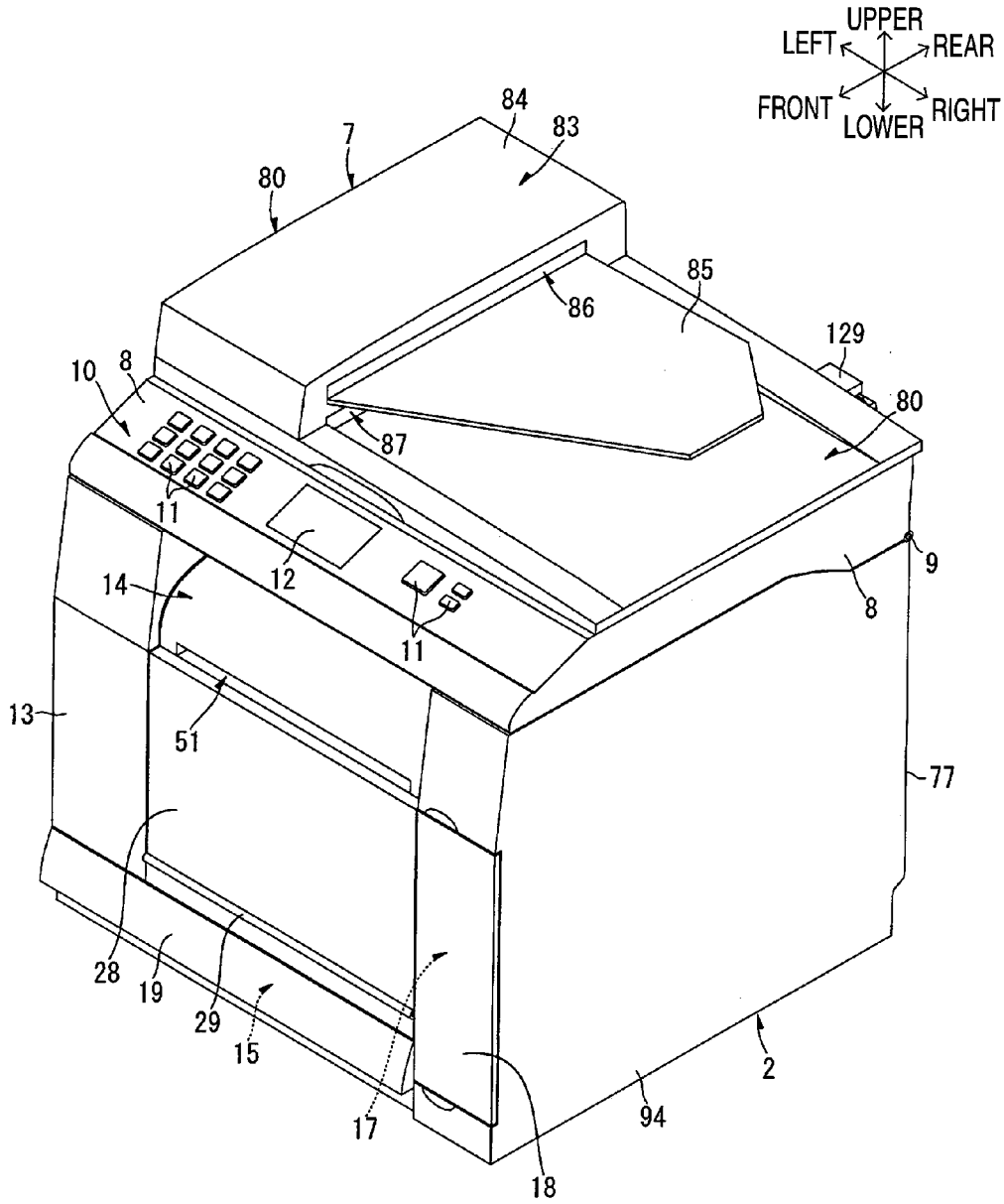
FIG. 4 is a right front side perspective view of the printer shown in FIG. 1.

As shown in FIG. 4, an operation panel 10 is provided with a plurality of buttons 11 and a display screen 12. An operation of the printer 1 may be controlled by operating the buttons 11, and the operation state is displayed on the display screen 12.

A front side wall 13 of the main body casing 2 is substantially parallel to the plane including the up-down direction and the right-left direction. In this front side wall 13, a sheet discharge port 14 is formed below the operation panel 10. The sheet discharge port 14 is long in the width direction and has a rectangular shape when viewed from front, and is formed at substantially the center, in the width direction, of the front side wall 13 and at the position adjacent to the operation panel 10.

A tray attachment-detachment port 15 is formed at the lower end of the front side wall 13. The tray attachment-detachment port 15 is long in the width direction and has a rectangular shape when viewed from front. When a sheet feeding tray 19 described later is attached to or detached from the main body casing 2, the sheet feeding tray 19 passes through the tray attachment-detachment port 15.

Figure 5:
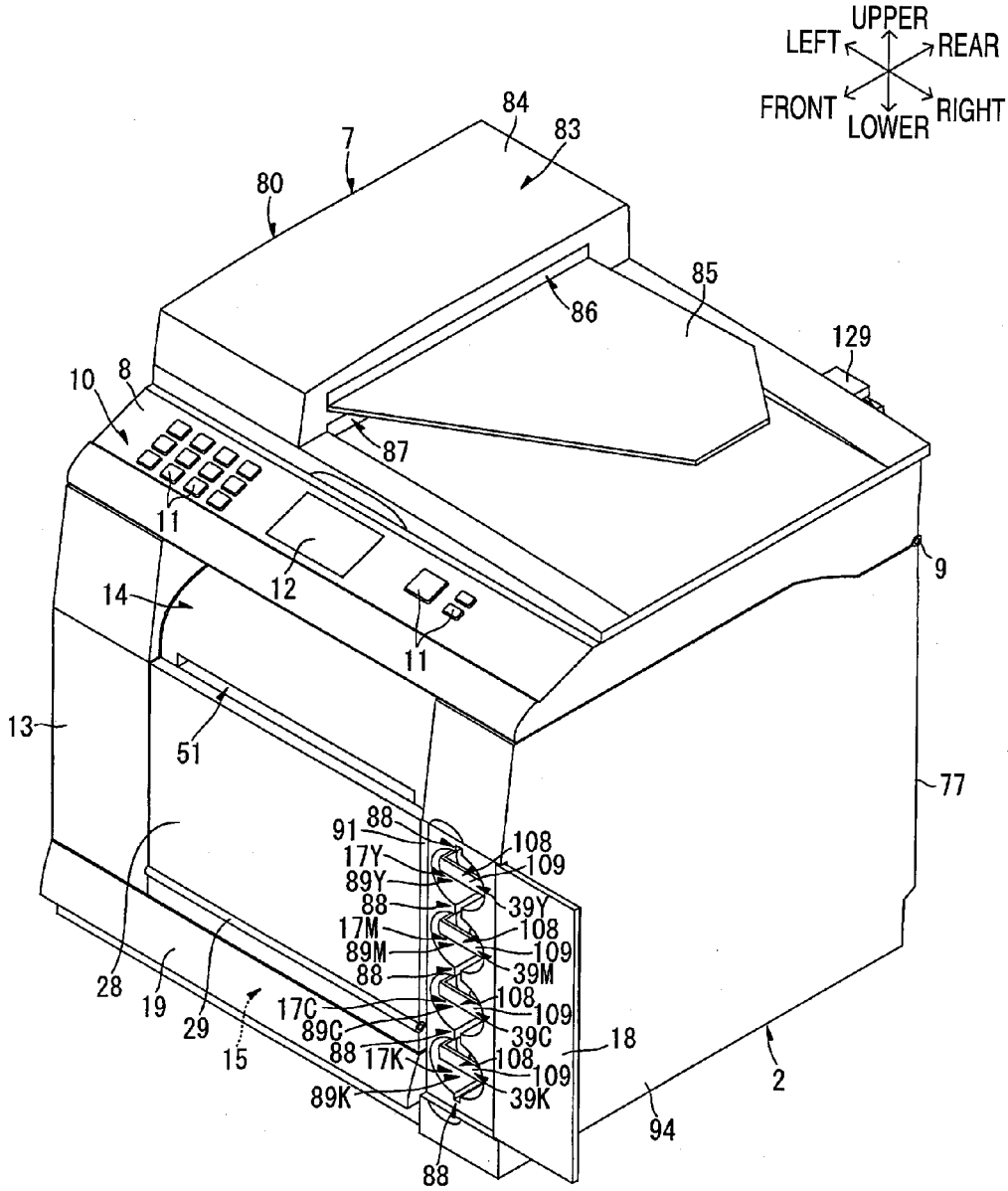
FIG. 5 is a view showing a state of the printer of FIG. 4 in which a cartridge door is opened.

In the front side wall 13, a plurality of cartridge attachment-detachment ports 17 are formed at a right upper part of the tray attachment-detachment port 15 and at a right lower part of the sheet discharge port 14 as shown in FIG. 5. The cartridge attachment-detachment port 17 has a circular shape when viewed from front, and four ports are formed along the up-down direction. When a toner cartridge 39, which is described in more detail later, is attached to and detached from the main body casing 2, the toner cartridge 39 passes through the corresponding cartridge attachment-detachment port 17. A cartridge door 18 is rotatably provided on the front side wall 13. In more detail, a rotation shaft (not shown) of the cartridge door 18 extends in the up-down direction at the front right end of the main body casing 2, and the cartridge door 18 is rotated between a closed position (see FIG. 4) in which the cartridge attachment-detachment ports 17 are closed and an open position (see FIG. 5) in which the cartridge attachment-detachment ports 17 are opened forward. Incidentally, as shown in FIG. 4, in the front side wall 13, recesses are formed at positions close to the upper end and the lower end of the cartridge door 18, and the recesses facilitate opening of the cartridge door 18 using, for example, a finger or tool.

In the front side wall 13, a processing door 28, which is a portion of the front side wall 13 surrounded by the sheet discharge port 14, the tray attachment-detachment port 15, and the cartridge attachment-detachment port 17 is swingable around a swing shaft 29 extending in the width direction. The processing door 28 swings between a closed position (see FIG. 4) in which the processing door 28 rises and closes the inside of the main body casing 2 and an open position (see FIG. 3) in which the processing door 28 tilts forward and opens the inside of the main body casing 2 forward. When the processing door 28 is at the open position, a jam removal process, for example, can be performed. The upper end of the processing door 28 is smoothly curved obliquely upward and rearward, and in the processing door 28, a slit 51 long in the width direction when viewed from front is formed in the lower end of the curved portion.

The slit 51 has a size in the width direction larger than a size of the sheet 3 in the width direction, and as shown in FIG. 1, the slit 51 passes through the processing door 28 in the front-rear direction. At the upper end of the processing door 28, there are provided a first pickup roller 55 and a first feed roller 56 exposed in the slit 51 from above and a first separation pad 57 exposed in the slit 51 from below.

The wall (called the first swing wall 58) slightly inclining obliquely downward and rearward is provided at the rear side of the upper end of the processing door 28. The first swing wall 58 is swingable around a swing shaft 59 extending in the width direction at the rear end thereof. In more detail, the first swing wall 58 swings between a closed position (see FIG. 1) in which the first swing wall 58 tilts and is continuous with the upper end of the processing door 28 and an open position (see FIG. 3) in which the first swing wall 58 stands and upward opens a portion (a drum receiving space 90 as an example of a first space described later) lower than the first swing wall 58 in the main body casing 2. A second conveying roller 40 and a second transfer roller 60 are rotatably provided at the lower side surface of the first swing wall 58 when the first swing wall 58 is at the closed position. Both the second conveying roller 40 and the second transfer roller 60 are long in the width direction, and are supported by the first swing wall 58 so that the lower surfaces are exposed downward from the lower side surface of the first swing wall 58. The secondary transfer roller 60 is disposed behind the second conveying roller 40. At the time of image formation, a secondary transfer bias is applied to the secondary transfer roller 60.

(2) Sheet Feeding Unit

As shown in FIG. 1, the sheet feeding unit 4 includes the sheet feeding tray 19 that is attachably and detachably mounted to and from the bottom in the main body casing 2 through the tray attachment-detachment port 15 from the front side of the main body casing 2. A second pickup roller 20, a second feed roller 21, a second separation pad 22 and a sheet dust removing roller 23 are provided above the front end of the sheet feeding tray 19 in the sheet feeding unit 4. The sheet feeding unit 4 includes a sheet feed path 25 extending slightly obliquely rearward and upward from the second feed roller 21 at the rear side of the processing door 28, and a pair of first conveying rollers 26 that are provided at the upper end of the sheet feed path 25 and are disposed to be opposite to each other. One first conveying roller 26 of the pair of first conveying rollers 26 is supported by the processing door 28 in the vicinity of the first feed roller 56, and the other first conveying roller 26 is supported by the scanner unit 30.

The sheets 3 stacked on the sheet feeding tray 19 are pressed to the second pickup roller 20 by a sheet pressing plate 24 provided in the sheet feeding tray 19, are conveyed to between the second feed roller 21 and the second separation pad 22 by the rotation of the second pickup roller 20, and are separated one by one. Thereafter, the sheet 3 passes through between the second feed roller 21 and the sheet dust removing roller 23, and after the sheet dust is removed by the sheet dust removing roller 23, the sheet is raised in the sheet feed path 25, and then is conveyed to a secondary transfer position 27 (described later) of the image forming unit 5 by the first conveying roller 26.

The slit 51 joins the sheet feed path 25. Thus, when the sheet 3 is manually fed into the slit 51 from the front side, this sheet 3 is conveyed to between the first feed roller 56 and the first separation pad 57 by the rotation of the first pickup roller 55 and is separated one by one. Thereafter, the sheet 3 reaches the sheet feed path 25, and is conveyed to the secondary transfer position 27 by the first conveying roller 26.

(3) Image Forming Unit

The image forming unit 5 includes the scanner unit 30, a process unit 31, a transfer unit 32, a cleaning unit 33 as an example of a collection unit, and a fixing unit 34.

(3-1) Scanner Unit

The scanner unit 30 is disposed at a position close to the front side in the body casing 2, and in more detail, the scanner unit 30 is disposed along the up-down direction so as to be adjacent to the sheet feed path 25 from the rear side. The scanner unit 30 includes a laser emission unit (not shown), a polygon minor 35 to be rotated and driven, and a plurality of reflecting mirrors 36. Four laser beams are emitted from the laser emission unit based on image data. Each of the laser beams is reflected by the polygon mirror 35 as indicated by an alternate long and short dash line, is reflected by the plurality of reflecting mirrors 36, and is scanned to the surface of a corresponding photosensitive drum 37 as an example of an image carrier.

(3-2) Process Unit

The process unit 31 includes four drum units 38 corresponding to respective colors of black, yellow, magenta and cyan, and four toner cartridges 39 respectively provided correspondingly to the respective drum units 38.

(3-2-1) Drum Unit

Figure 3:
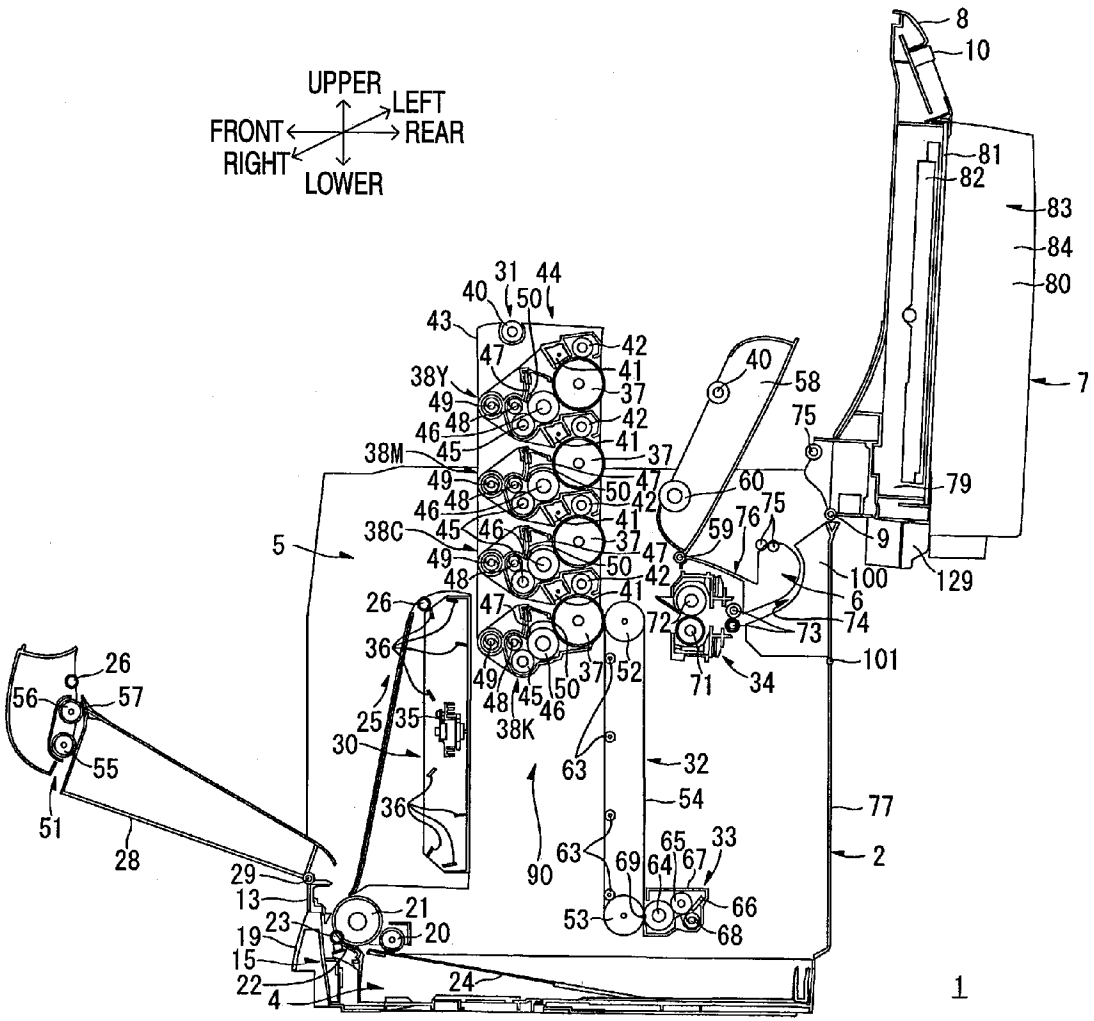
FIG. 3 is a view showing a state of the printer of FIG. 1 in which a drum section is attached to and detached from a main body casing of the printer.

The drum unit 38 is long in the width direction and has a substantially rectangular parallelepiped shape. The plurality of drum units 38 are disposed in parallel along the substantially vertical direction in a state in which they are held by the same frame 43, and are disposed adjacently to the rear side of the scanner unit 30. In the following, the plurality of drum units 38 and the frame 43 are sometimes referred to as a drum section 44. In the main body casing 2, a space that receives the drum section 44 is called a drum receiving space 90. The drum receiving space 90 is the space between the scanner unit 30 and the transfer unit 32, and has a rectangular parallelepiped shape long in the up-down direction. The upper end of the drum receiving space 90 is closed from above by the first swing wall 58 located at the closed position. As shown in FIG. 3, when the upper side wall 8 and the first swing wall 58 are respectively swung to the open position, and the upper surface (drum receiving space 90) of the main body casing 2 is opened upward, the drum section 44 can be attached to and detached from the main body casing 2 along the up-down direction (substantially vertical direction) from above the main body casing 2.

As shown in FIG. 1, each of the drum units 38 includes a photosensitive drum 37, a scorotron charger 41, a cleaning roller 42, a supply roller 45, a developing roller 46 as an example of a developer carrier and a toner carrier, a layer thickness regulating blade 47, a supply auger 48 as an example of a conveying member and a second conveying member, and a return auger 49.

The photosensitive drum 37 is long in the width direction, has an outermost layer made of a positive charging photosensitive layer, and has a cylindrical shape, and the rear side surface is exposed rearward from the frame 43. The photosensitive drum 37 is rotated by drive force from a motor (not shown) provided in the main body casing 2 at the time of image formation.

The scorotron charger 41 is provided obliquely in front of and above the photosensitive drum 37 and is disposed to be opposite to the photosensitive drum 37 while an interval is provided. At the time of image formation, a high voltage is applied, and the surface of the photosensitive drum 37 is uniformly positively charged.

The cleaning roller 42 is long in the width direction, is provided over the photosensitive drum 37, and is disposed to be opposite to the photosensitive drum 37 and to come in contact with the surface thereof. At the time of image formation, a cleaning bias to collect a toner is applied to the cleaning roller 42, and at the time of end of the image formation, a bias opposite to the cleaning bias is applied.

The developing roller 46 is long in the width direction, is provided obliquely in front of and below the photosensitive drum 37, and is disposed to be opposite to the photosensitive drum 37 and to come in contact with the surface thereof. The developing roller 46 includes a metal developing roller shaft that is rotatably supported by both side walls, in the width direction, of the frame 43, and a rubber roller unit that covers the developing roller shaft and is made of conductive rubber. Incidentally, the rubber roller unit comes in contact with the photosensitive drum 37. At the time of image formation, the drive force from the motor (not shown) provided in the main body casing 2 is transmitted, and the developing roller 46 is rotated. Besides, a development bias is applied to the developing roller 46.

The supply roller 45 is long in the width direction, is provided obliquely in front of and below the developing roller 46, and is disposed to be opposite to the developing roller 46 and to come in contact with the surface thereof. The supply roller 45 includes a metal supply roller shaft that is rotatably supported by both the side walls, in the width direction, of the frame 43, and a sponge roller unit that covers the supply roller shaft and is made of conductive sponge. Incidentally, the sponge roller unit comes in contact with the rubber roller unit of the developing roller 46. At the time of image formation, the drive force from the motor (not shown) provided in the main body casing 2 is transmitted, and the supply roller 45 is rotated.

The layer thickness regulating blade 47 is provided above the developing roller 46. The layer thickness regulating blade 47 includes a plate spring member that extends substantially downward to the developing roller 46, and a press contact rubber 50 that is provided at the end (lower end) of the plate spring member and comes in press contact with the developing roller 46 from an obliquely front upper part.

The supply auger 48 is disposed above the supply roller 45. The supply auger 48 includes a shaft that extends in the width direction and is rotatably supported by both the side walls, in the width direction, of the frame 43, and a helical vane that is formed on the surface of the shaft. At the time of image formation, the drive force from the motor (not shown) provided in the main body casing 2 is transmitted and the supply auger 48 is rotated.

The return auger 49 is disposed in front of the supply auger 48. The return auger 49 includes a shaft that extends in the width direction and is rotatably supported by the left side wall of the frame 43, and a helical vane formed on the surface of the shaft. At the time of image formation, the drive force from the motor (not shown) provided in the main body casing 2 is transmitted, and the return auger 49 is rotated.

The second conveying roller 40 is rotatably provided at the upper end of the frame 43. The second conveying roller 40 is long in the width direction, and is supported by the frame 43 so that the upper surface thereof is exposed upward from the upper surface of the frame 43. When the first swing wall 58 is at the closed position, the second conveying roller 40 of the first swing wall 58 and the second conveying roller 40 of the frame 43 are opposite to each other. At this time, a gap (called a relay path 61) is formed between the lower surface of the first swing wall 58 and the upper surface of the frame 43. The relay path 61 is continuous from the upper end of the sheet feed path 25, and extends to the secondary transfer position 27.

The drum unit 38 will be described later in more detail.

(3-2-2) Toner Cartridge

Figure 2:
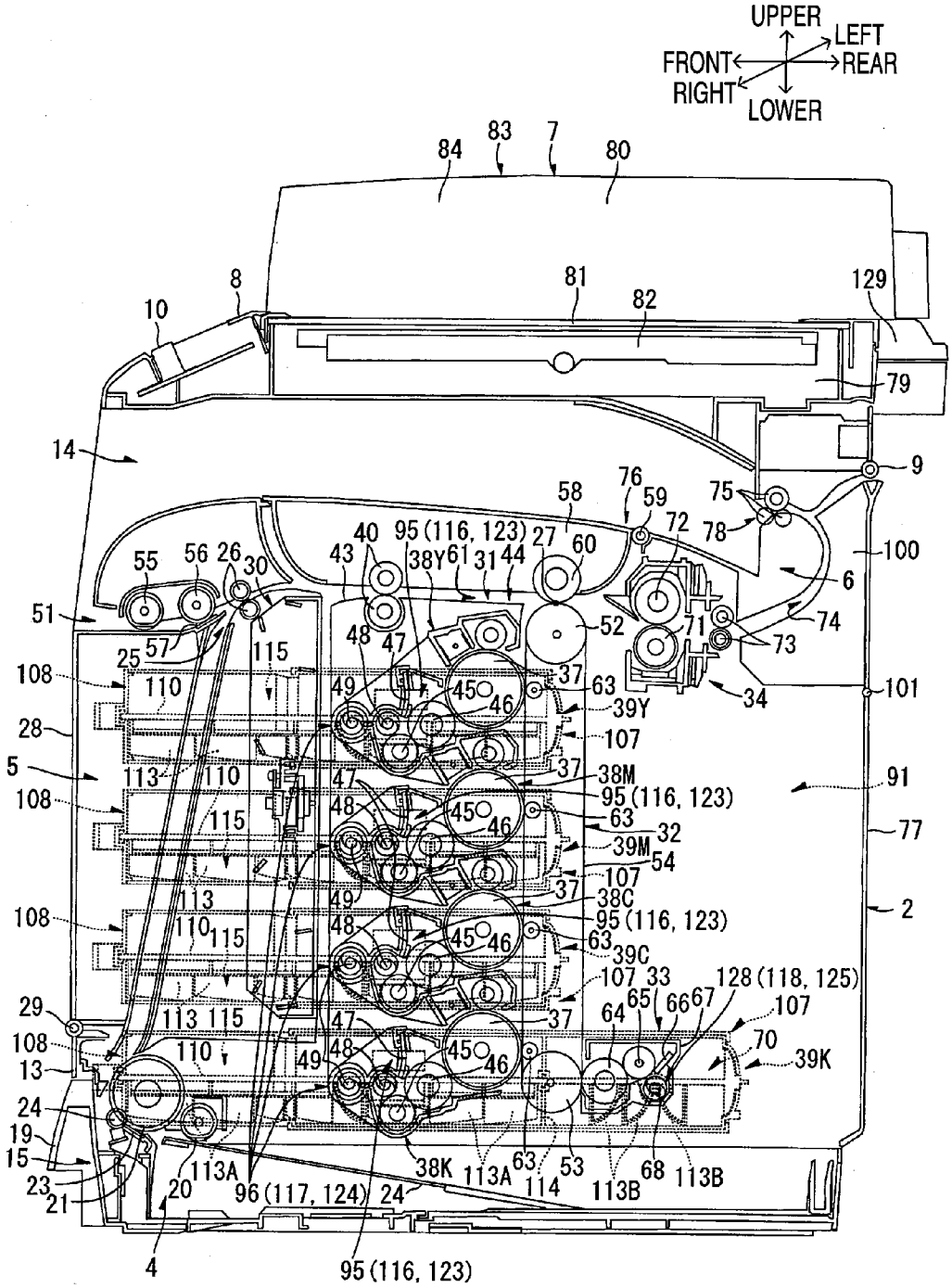
FIG. 2 is a view in which a toner cartridge is added to the printer in FIG. 1.

As shown in FIG. 2, the toner cartridge 39 has a cylindrical shape long in the front-rear direction, and is disposed at the right side of the drum unit 38 so as to be opposite to the right end of the corresponding drum unit 38 along the substantially horizontal direction (width direction). In a state of being mounted to the main body casing 2, each of the toner cartridges 39 is sandwiched between the front side wall 13 of the main body casing 2 and a rear side wall 77 (opposite to the front side wall 13 in the front-rear direction) as an example of a second side wall, and in more detail, the toner cartridges 39 extend (protrude) to the front side wall 13. The front end of each of the toner cartridges 39 is positioned at the forward side (the front side wall 13 side) of process means (the scanner unit 30, the drum section 44, the transfer unit 32, and the cleaning unit 33) operating for image formation and the sheet feed path 25.

Toners of different colors are contained in the respective toner cartridges 39 (in more detail, new toner containing units 115 as an example of a first containing unit described later). As an example of toners of the respective colors, positive-charge-type non-magnetic one-component polymerized toners are used in which respective coloring agents of yellow, magenta, cyan and black are mixed correspondingly to the respective colors. The toner is excellent in fluidity. In the drawing, the respective toner cartridges 39 are classified into a yellow toner cartridge 39Y, a magenta toner cartridge 39M, a cyan toner cartridge 39C, and a black toner cartridge 39K according to the color of the contained toner. The respective drum units 38 are also classified into a yellow drum unit 38Y, a magenta drum unit 38M, a cyan drum unit 38C, and a black drum unit 38K according to the color of the toner. The drum units 38 and the toner cartridges 39 are disposed in parallel along the substantially vertical direction in the order of black, cyan, magenta and yellow from below to above.

The toner cartridge 39 will be described later in more detail.

(3-2-3) Development Operation in Process Unit

With reference to FIG. 1, at the time of image formation, the toner contained in each of the toner cartridges 39 is supplied to the supply auger 48 of the corresponding drum unit 38. The toner supplied to the supply auger 48 is conveyed to the left by the vane of the supply auger 48, drops to the supply roller 45 below the supply auger 48, and is supplied to the supply roller 45. The toner that is not supplied to the supply roller 45 but is conveyed to the left end of the supply auger 48 is delivered to the return auger 49, is conveyed to the right side, and is returned to the toner cartridge 39. The toner returned to the toner cartridge 39 is again supplied to the supply auger 48. As described above, the toner is circulated between the toner cartridge 39 and the drum unit 38. Incidentally, the circulation of the toner will be described later in detail.

The toner supplied to the supply roller 45 is supplied to the developing roller 46 by the rotation of the supply roller 45. At this time, the toner is friction-charged to a positive polarity between the supply roller 45 and the developing roller 46 to which the development bias is applied. The positively charged toner supplied to the developing roller 46 in this way enters between the press rubber 50 of the layer thickness regulating blade 47 and the developing roller 46, and is carried as a thin layer having a constant thickness on the surface of the developing roller 46.

On the other hand, as the photosensitive drum 37 is rotated, the surface of the photosensitive drum 37 is uniformly positively charged by the scorotron charger 41. Then, the laser beam (see the alternate long and short dash line of FIG. 1) from the scanner unit 30 is irradiated to the surface of the positively charged photosensitive drum 37, so that an electrostatic latent image corresponding to an image to be formed on the sheet 3 is formed.

When the electrostatic latent image formed on the surface of the photosensitive drum 37 becomes opposite to the developing roller 46 by the rotation of the photosensitive drum 37, the positively charged toner carried on the surface of the developing roller 46 is supplied to the electrostatic latent image (that is, in the surface of the uniformly positively charged photosensitive drum 37, a light exposure portion which is exposed by the laser beam and the potential of which is lowered). By this, the electrostatic latent image is visualized and the toner image by inversion development is carried on the surface of the photosensitive drum 37.

(3-3) Transfer Unit

In the main body casing 2, the transfer unit 32 is disposed along the up-down direction so as to be adjacent to the plurality of drum units 38 (drum sections 44) from the rear side. The transfer unit 32 includes a transfer frame (not shown), a driving roller 52 supported by the transfer frame, a driven roller 53 as an example of a roller, a transfer belt 54 as an example of a belt, and four primary transfer rollers 63. As shown in FIG. 3, when the upper side wall 8 and the first swing wall 58 are swung to the open position, and the upper surface of the main body casing 2 is opened upward, the transfer unit 32 can be attached to and detached from the main body casing 2 along the up-down direction from the upper surface of the main body casing 2.

As shown in FIG. 1, the driving roller 52 and the driven roller 53 extend in the width direction, and are disposed to be opposite to each other in the up-down direction while an interval is provided therebetween. Specifically, the driving roller 52 is positioned above the photosensitive drum 37 of the yellow drum unit 38Y and is rotatably supported by the transfer frame (not shown). The driven roller 53 is positioned below the driving roller 52, particularly below the photosensitive drum 37 of the black drum unit 38K and is rotatably supported by the transfer frame (not shown).

The transfer belt 54 is made of an endless belt made of resin such as polycarbonate, and is stretched between the driving roller 52 and the driven roller 53. As shown in FIG. 1, the left side surface of the transfer belt 54 is in contact with the photosensitive drums 37 of the respective drum units 38. Here, contact positions of the respective photosensitive drums 37 and the transfer belt 54 are respectively called primary transfer positions 62. When the first swing wall 58 is at the closed position, the secondary transfer roller 60 and the driving roller 52 are opposite to each other across the transfer belt 54. At this time, the secondary transfer roller 60 and the transfer belt 54 are in contact with each other, and this contact position is the secondary transfer position 27.

The primary transfer roller 63 extends in the width direction, and is rotatably supported by the transfer frame (not shown) within the transfer belt 54 stretched between the driving roller 52 and the driven roller 53. The primary transfer rollers 63 are provided correspondingly to the respective drum units 38, and are opposite to the corresponding photosensitive drums 37 at the primary transfer positions 62 across the transfer belt 54. At the time of image formation, a primary transfer bias is applied to the primary transfer roller 63.

At the time of image formation, the drive force from a motor (not shown) provided in the main body casing 2 is transmitted to the driving roller 52, and the driving roller 52 is rotated. Then, the transfer belt 54 circulates between the driving roller 52 and the driven roller 53 so as to rotate in the opposite direction (clockwise direction in FIG. 1) to the photosensitive drum 37, and the driven roller 53 and the primary transfer rollers 63 are driven and rotated.

The transfer belt 54 sequentially passes through the respective primary transfer positions 62 from below to above. During the passage, toner images carried by the photosensitive drums 37 of the respective drum units 38 are sequentially transferred to the transfer belt 54 at the primary transfer positions 62 by the primary transfer biases applied to the respective primary transfer rollers 63. That is, the black toner image of the black drum unit 38K is transferred to the transfer belt 54, and next, the cyan toner image of the cyan drum unit 38C is transferred to superimpose on the black toner image on the transfer belt 54. Thereafter, by a similar procedure, the magenta toner image of the magenta drum unit 38M and the yellow toner image of the yellow drum unit 38Y are sequentially superimposed and transferred onto the transfer belt 54, and a color image is formed on the transfer belt 54.

While the transfer belt 54 is passing through the secondary transfer position 27, the color image formed on the transfer belt 54 is collectively transferred onto the sheet 3 conveyed to the secondary transfer position 27 from the sheet feeding unit 4 through the relay path 61 by the secondary transfer bias applied to the secondary transfer roller 60. The sheet 3 on which the color image is transferred is conveyed to the fixing unit 34.

Toner that remains on the photosensitive drum 37 after the transfer of the toner image onto the transfer belt 54 is collected by the cleaning roller 42. At the end of image formation, a bias for discharging the toner is applied to the cleaning roller 42, so that the toner is collected by the developing roller 46 after being discharged to the photosensitive drum 37.

(3-4) Cleaning Unit

The cleaning unit 33 is disposed to be adjacent to the transfer unit 32. In more detail, the cleaning unit 33 is disposed to be adjacent to the lower end of the transfer unit 32 from the rear side, and is opposite to the driven roller 53 across the transfer belt 54. The cleaning unit 33 includes a box-shaped cleaning casing 67, a primary cleaning roller 64 received in the cleaning casing 67, a secondary cleaning roller 65, a scraping blade 66, and a discharge auger 68 as an example of a first conveying member.

Both the primary cleaning roller 64 and the secondary cleaning roller 65 are long in the width direction, and are rotatably supported by both side walls, in the width direction, of the cleaning casing 67.

The primary cleaning roller 64 is disposed to be opposite to the driven roller 53 across the transfer belt 54. At this time, the primary cleaning roller 64 is in contact with the transfer belt 54, and the contact position between the primary cleaning roller 64 and the transfer belt 54 is called a cleaning transfer position 69. A primary cleaning bias is applied to the primary cleaning roller 64. The secondary cleaning roller 65 is disposed in an obliquely rear upper part of the primary cleaning roller 64, is opposite to the primary cleaning roller 64, and is disposed so as to come in contact with the surface thereof. A secondary cleaning bias is applied to the secondary cleaning roller 65.

The scraping blade 66 is provided so as to come in contact with the secondary cleaning roller 65 from behind.

The discharge auger 68 is disposed below the contact position between the scraping blade 66 and the secondary cleaning roller 65. The discharge auger 68 includes a shaft that extends in the width direction and is rotatably supported by the left side wall, in the width direction, of the cleaning casing 67, and a helical vane formed on the surface of the shaft. At the time of image formation, the drive force from the motor (not shown) provided in the main body casing 2 is transmitted, and the discharge auger 68 is rotated.

In the transfer operation of a color image, the toner remaining on the surface of the transfer belt 54 is first transferred from the surface of the transfer belt 54 to the primary cleaning roller 64 by the primary cleaning bias at the cleaning transfer position 69, and is collected by the cleaning unit 33. The toner transferred to the primary cleaning roller 64 is transferred to the secondary cleaning roller 65 by the secondary cleaning bias. Thereafter, the toner transferred to the secondary cleaning roller 65 is scraped by the scraping blade 66, and drops from the secondary cleaning roller 65 to the discharge auger 68. As described in more detail later, the toner dropped to the discharge auger 68 is conveyed as waste toner to a waste toner discharge port 128 (see FIG. 2) as an example of a housing side opening at the right side, and is contained in a waste toner containing unit 70 (see FIG. 2) as an example of a second containing unit in the toner cartridge 39.

(3-5) Fixing Unit

The fixing unit 34 is disposed behind the secondary transfer position 27. The fixing unit 34 includes a heating roller 71 and a pressing roller 72 to press the heating roller 71. In the fixing unit 34, the color image transferred on the sheet 3 is heated and pressed while the sheet 3 is passing through between the heating roller 71 and the pressing roller 72, so that the color image is heated and fixed to the sheet 3.

(4) Sheet Discharging Unit

The sheet discharging unit 6 includes a pair of conveying rollers 73, a sheet discharge path 74, discharge rollers 75 and a sheet discharging tray 76. The pair of conveying rollers 73 are provided behind the heating roller 71 and the pressing roller 72 and are disposed so as to come in contact with each other. The sheet discharge path 74 extends within a rear side wall 77 of the main body casing 2 from the contact position of the pair of conveying rollers 73 to an obliquely rear upper part while curving, and extends to be smoothly folded back forward. A sheet discharge port 78 as an outlet of the sheet discharge path 74 is formed on the front surface of the rear side wall 77. The discharge rollers 75 are three rollers disposed in the sheet discharge port 78, and one roller thereof is in contact with the other two rollers. The sheet discharging tray 76 extends forward from a part below the sheet discharge port 78 at the front side surface of the rear side wall 77. The upper side surface of the first swing wall 58 and the upper end of the processing door 28 are included in the sheet discharging tray 76.

The sheet 3 on which the color image is fixed by the fixing unit 34 is conveyed along the sheet discharge path 74 by the conveying roller 73 in the sheet discharging unit 6, and is discharged onto the sheet discharging tray 76 through the sheet discharge port 78 by the discharge roller 75. At this time, the surface (i.e., the print surface) of the sheet 3 on which the color image is fixed is turned upward.

(5) Reading Scanner Unit

The reading scanner unit 7 includes a document table 79 connected to the upper side wall 8 (in more detail, embedded in the upper side wall 8) and a press cover 80 swingably supported on the document table 79.

The document table 79 is formed into a rectangular plate shape when viewed in plane, and a glass surface 81 on which an original document is placed is provided at the upper surface thereof. A CCD sensor 82 for reading the original document is incorporated in the document table 79. The CCD sensor 82 stands by at the left end of the glass surface 81 (this position is called a standby position), and at the time of normal original document reading, the CCD sensor slides from the left to the right in a state in which it is opposite to the glass surface 81.

The press cover 80 is formed into a rectangular plate shape, when viewed in plane, similar to the document table 79. The rear end of the press cover 80 and the rear end of the document table 79 are coupled by a hinge 129, and the press cover 80 swings between a closed position (see FIG. 1) in which the press cover 80 tilts and closes the glass surface 81 from above and an open position (not shown) in which the press cover 80 stands and exposes the glass surface 81 obliquely forward and upward. As shown in FIG. 4, an Auto Document Feeder (ADF) 83 for automatically reading an original document is provided at the left end of the press cover 80. The ADF 83 includes a box-shaped ADF casing 84 and a standby tray 85 that extends from the right wall of the ADF casing 84 to the right and has a trapezoidal thin plate shape when viewed in plane. An original document conveying roller (not shown) and an original document detection sensor (not shown) are provided in the inside of the ADF casing 84. In the right side wall of the ADF casing 84, a take-in port 86 is formed above the standby tray 85, and a take-out port 87 is formed below the standby tray 85.

In the reading scanner unit 7, in the case of normal original document reading, the press cover 80 is swung to the open position, an original document is placed on the glass surface 81 (see FIG. 1), the press cover 80 is swung to the closed position, and the button 11 of the operation panel 10 is operated. By this, the CCD sensor 82 at the standby position slides from the left to the right in the state in which the CCD sensor 82 is opposite to the original document placed on the glass surface 81, and image information of the original document is read. Thereafter, the press cover 80 is again swung to the open position, and the original document is removed from the glass surface 81. The CCD sensor 82 is automatically returned to the standby position.

On the other hand, in the case of automatic reading of an original document by the ADF 83, when the original document detection sensor (not shown) detects that the original document is set on the standby tray 85, the CCD sensor 82 is fixed at a not-shown auto document reading position differently from the normal original document reading. Then, when the button 11 is operated, the original document conveying roller (not shown) of the ADF 83 is rotated, the original document is drawn by the original document conveying roller (not shown), is moved leftward, and is taken into the ADF casing 84 through the take-in port 86. When the original document that is taken in becomes opposite to the CCD sensor 82, image information of the original document is read by the CCD sensor 82. Thereafter, the original document is discharged from the take-out port 87.

The image forming unit 5 creates image data based on the image information of the original document read as described above, and forms an image on the sheet 3.

2. Structure of Respective Components (1) Main Body Casing

As shown in FIG. 5, in the main body casing 2, the cartridge attachment-detachment ports 17 adjacent to each other in the up-down direction are coupled through a notch 88 having a rectangular shape when viewed from front. Here, the cartridge attachment-detachment ports 17 are also classified into a yellow cartridge attachment-detachment port 17Y, a magenta cartridge attachment-detachment port 17M, a cyan cartridge attachment-detachment port 17C, and a black cartridge attachment-detachment port 17K from above in sequence according to the toner color similarly to the toner cartridges 39. The notch 88 is formed also at the upper end of the yellow cartridge attachment-detachment port 17Y and at the lower end of the black cartridge attachment-detachment port 17K.

Four cartridge receiving spaces 89 for receiving the toner cartridges 39 are formed as an example of a second space at the right end of the main body casing 2. Each of the cartridge receiving spaces 89 has a cylindrical shape long in the front-rear direction, and communicates with the corresponding cartridge attachment-detachment port 17 at the front side. Here, the cartridge receiving spaces 89 are also classified into a yellow cartridge receiving space 89Y, a magenta cartridge receiving space 89M, a cyan cartridge receiving space 89C, and a black cartridge receiving space 89K from above in sequence according to the toner color similarly to the cartridge attachment-detachment ports 17. Of course, it is also possible to provide the cartridge attachment-detachment ports 17 and the cartridge receiving spaces 89 in another sequence. Similarly to the cartridge attachment-detachment ports 17, the cartridge receiving spaces 89 adjacent to each other in the up-down direction are coupled through a notch 88 in the front-rear direction. The notch 88 of the upper end of the yellow cartridge attachment-detachment port 17Y is formed in the front-rear direction at the upper end of the yellow cartridge receiving space 89Y. Similarly, the notch 88 of the lower end of the black cartridge attachment-detachment port 17K is formed in the front-rear direction at the lower end of the black cartridge receiving space 89K. Incidentally, the four cartridge receiving spaces 89 in the communication state are sometimes collectively called the cartridge receiving space 89.

Figure 11A:
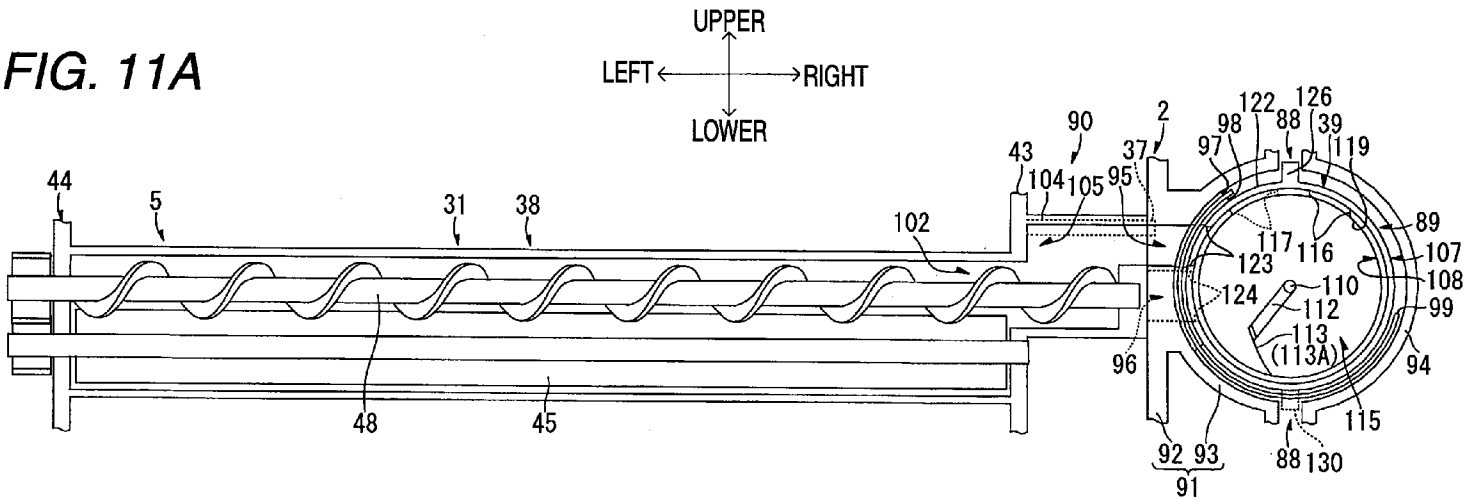
FIGS. 11A and 11B are front sectional views of the printer of FIG. 1 showing a state in which toner is moved between the toner cartridge and a drum unit.
Figure 11B:
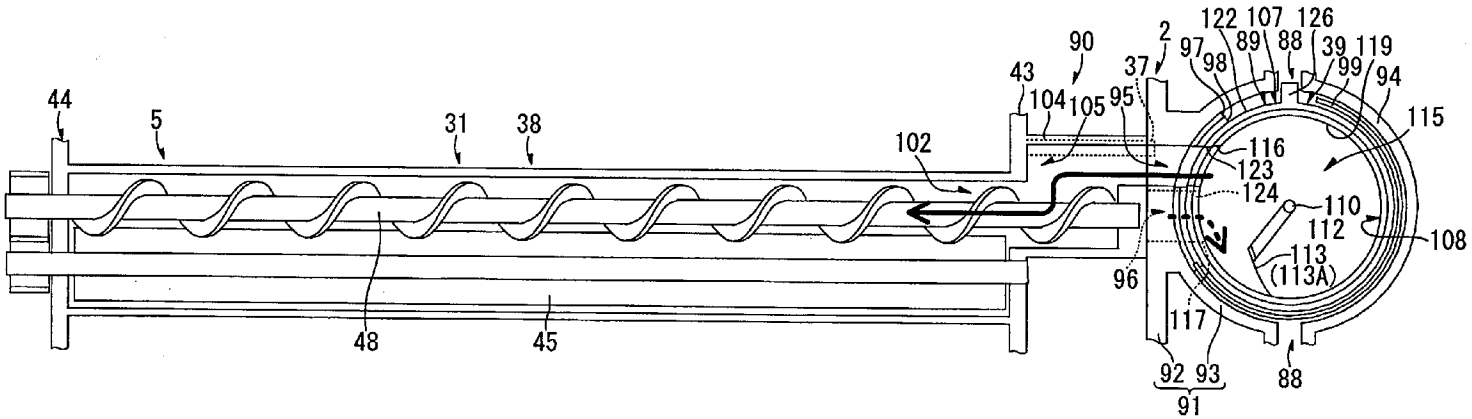
Figure 12A:
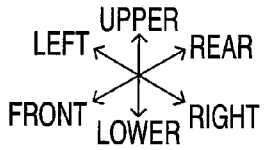
FIGS. 12A and 12B are right front side perspective views of a body shutter of the toner cartridge of the printer of FIG. 1.
Figure 12A:
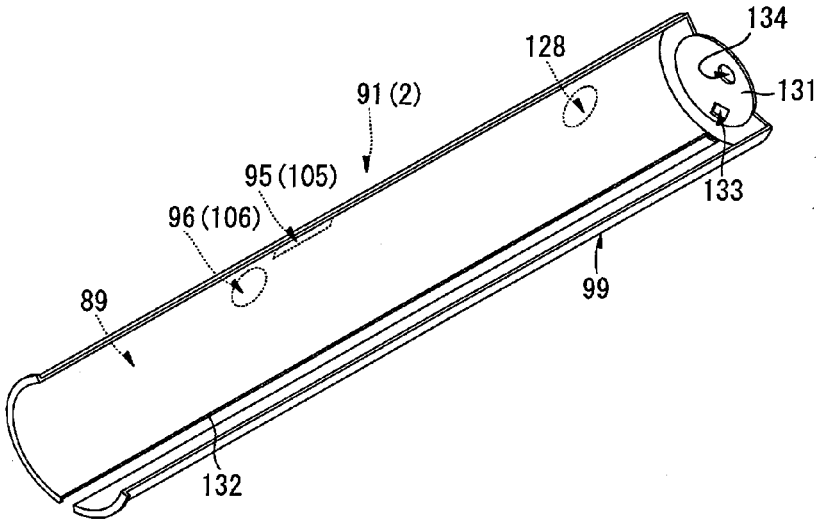
Figure 12B:
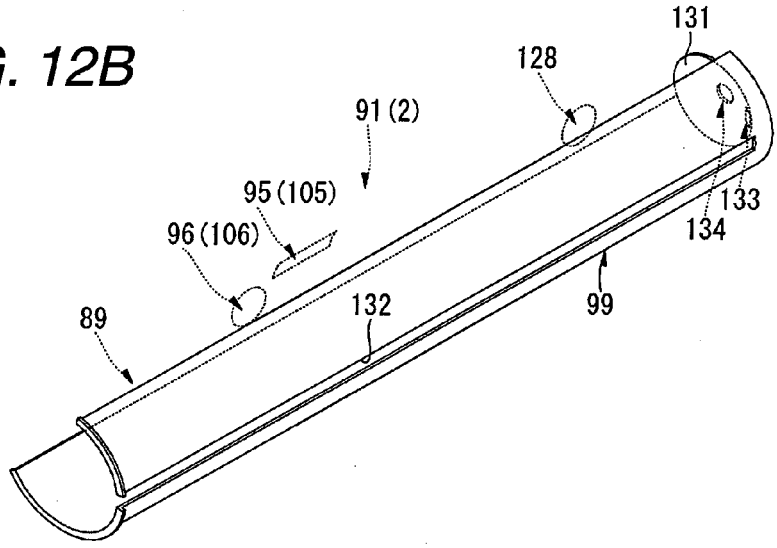

As shown in FIGS. 11A and 11B, the main body casing 2 is provided with a partition wall 91 that partitions the space of the main body casing 2 into the cartridge receiving space 89 and the drum receiving space 90. In more detail, the partition wall 91 integrally includes a plane unit 92 that extends along the up-down direction and is thin in the width direction when viewed in front section, and four curved units 93 that are provided side by side in the up-down direction at the right side of the plane unit 92 and have substantially C-shapes when viewed in front section. Incidentally, an inversely C-shaped wall, when viewed in front section, that is disposed at the right side of each of the curved surface units 93 and is opposite to the curved unit 93 across the corresponding cartridge receiving space 89 and the notch 88 is a left side portion of the right side wall 94 of the main body casing 2. In the partition wall 91, a partition wall side supply port 95 as an example of a first partition opening and a partition wall side return port 96 as an example of a second partition wall opening are formed in a portion (in more detail, a connection portion between the plane unit 92 and the curved unit 93) corresponding to each of the cartridge receiving spaces 89. That is, in the partition wall 91, two ports comprising the partition wall side supply port 95 and the partition wall side return port 96 are formed for each of the four cartridge receiving spaces 89. That is, each of the four cartridge receiving spaces 89 comprises a partition wall side supply port 95 and a partition wall side return port 96. For each cartridge receiving space 89, the partition wall side supply port 95 is positioned above the partition wall side return port 96. As shown in FIGS. 12A and 12B, the partition wall side supply port 95 is positioned behind the partition wall side return port 96. Incidentally, in FIGS. 11A and 11B, for convenience of description, the partition wall side supply port 95 and the partition wall side return port 96 are shown on the same plane. Moreover, the partition wall side supply port 95 has a rectangular shape, and the partition wall side return port 96 has a circular shape with an opening area smaller than that of the partition wall side supply port 95, as shown in FIGS. 12A and 12B.

As shown in FIG. 2, the lowermost curved unit 93 of the four curved units 93 provided side by side in the up-down direction is provided with a waste toner discharge port 128 behind the partition wall side supply port 95. The waste toner discharge port 128 is a circular hole, passes through the partition wall 91 and the right side wall of the cleaning casing 67 of the cleaning unit 33, and is opposite to the discharge auger 68 from the right side. That is, the waste toner discharge port 128 is formed over both the main body casing 2 (partition wall 91) and the cleaning unit 33.

As shown in FIGS. 11A and 11B, each of the cartridge receiving spaces 89 receives a first seal 97, and a body shutter 99 as an example of a housing side shutter.

The first seal 97 is a sheet made of, for example, felt. The first seal 97 is attached to the right side surface of the curved unit 93 so as not to close the partition wall side supply port 95 and the partition wall side return port 96 and so as to surround the partition wall side supply port 95 and the partition wall side return port 96.

As shown in FIGS. 12A and 12B, the body shutter 99 is formed into a substantially C-shaped thin plate shape, when viewed in front section, long in the front-rear direction, and the rear edge thereof is closed by a plate (called a semicircular plate 131) having a substantially semicircular shape when viewed from front. The semicircular plate 131 is integral with the body shutter 99. The size of the body shutter 99 in the front-rear direction is almost equal to the size of the toner cartridge in the front-rear direction except a handle 109 (see FIGS. 8A and 8B). A rectangular cut reception unit 132 is formed at one place on the periphery of the front end of the body shutter 99. The reception unit 132 extends along the front-rear direction to almost the rear edge of the body shutter 99. In the peripheral part of the semicircular plate 131, a rectangular through-hole 133 is formed at a position adjacent to the reception unit 132 in the front-rear direction. A circular insertion hole 134 is formed at the circle center position of the semicircular plate 131.

As show in FIGS. 11A and 11B, the body shutter 99 is rotatable along the right side surface of the curved unit 93 and the left side surface of the right side wall 94. In more detail, the body shutter 99 is rotated between a closed position (see FIG. 11A and FIG. 12A) and an open position (see FIG. 11B and FIG. 12B). As shown in FIG. 11A and FIG. 12A, the body shutter 99 at the closed position enters between the first seal 97 and a second seal 98 (described later) provided in the toner cartridge 39 and separates these seals, and closes the partition wall side supply port 95, the partition wall side return port 96 and the waste toner discharge port 128 (see FIG. 2) from the right side. When the body shutter 99 is at the closed position, the reception unit 132 (see FIG. 12A) is almost coincident with the lower notch 88 (see FIG. 5) in the corresponding cartridge receiving space 89. The open position is the position in which the body shutter 99 at the closed position is rotated counterclockwise when viewed from front. As shown in FIG. 11B and FIG. 12B, at the lower end of the first seal 97 and the second seal 98, the body shutter 99 at the open position rotates between the first seal 97 and the second seal 98, and opens the partition wall side supply port 95, the partition wall side return port 96, and the waste toner discharge port 128 (see FIG. 2) to the right side. As stated above, the body shutter 99 rotates between the open position and the closed position, and simultaneously opens and closes (see FIG. 12) the partition wall side supply port 95, the partition wall side return port 96 and the waste toner discharge port 128 (see FIG. 2).

As shown in FIG. 1, in the rear side wall 77, a portion (called a second swing wall 100) positioned behind the sheet discharge path 74 is independent of the other portion. In more detail, the second swing wall 100 is swingable around a swing shaft 101 extending in the width direction at the lower end thereof. In more detail, the second swing wall 100 swings between a closed position (see FIG. 1) in which the second swing wall 100 stands along the rear side wall 77 below the second swing wall 100, and an open position (not shown) in which the second swing wall 100 is tilted rearward to expose the sheet discharge path 74 to the rear side. When the second swing wall 100 is at the open position, a jam clearing process in the sheet discharge path 74 can be performed.

(2) Drum Section

Figure 7:
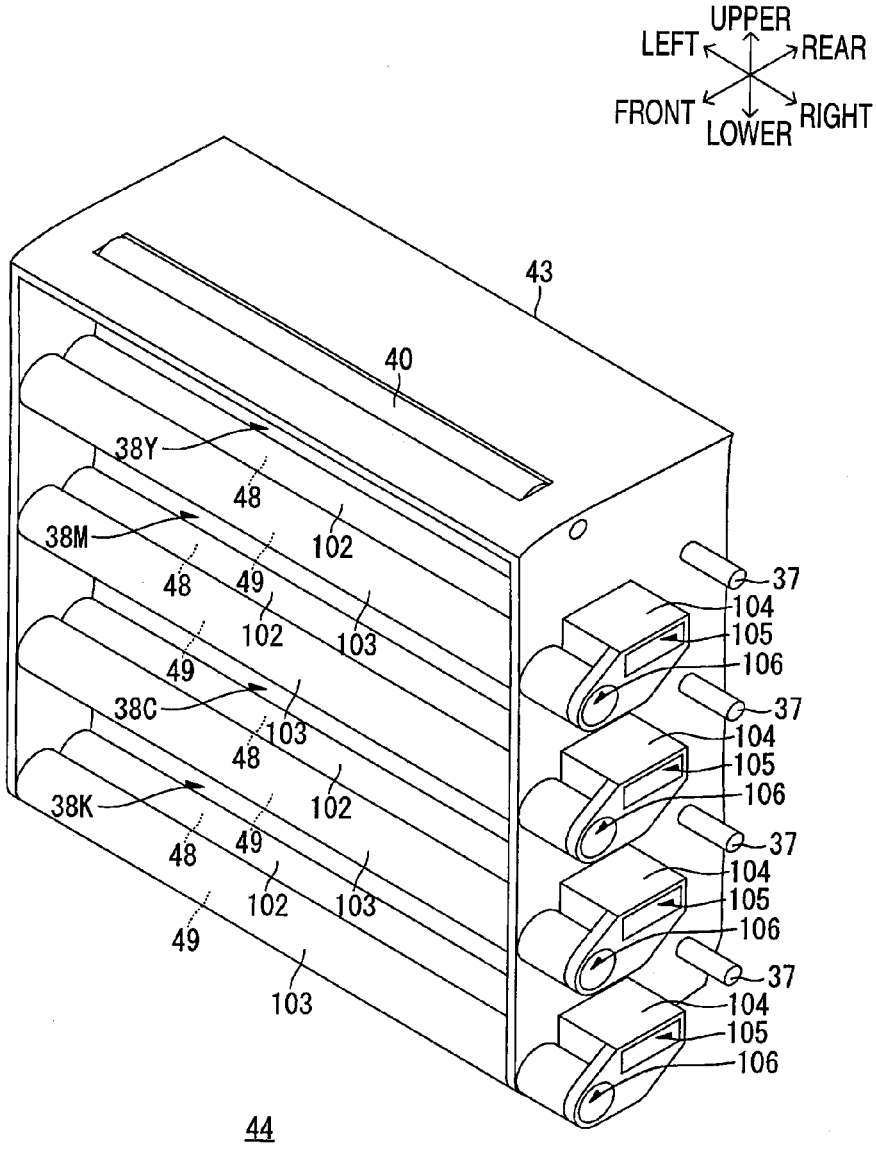
FIG. 7 is a right front side perspective view of the drum section of the printer of FIG. 1.

As shown in FIG. 7, the frame 43 of the drum section 44 has a box shape long in the up-down direction. At the front side of the frame 43, four pairs each including a supply auger receiving unit 102 and a return auger receiving unit 103 are provided side by side in the up-down direction. Each pair of the supply auger receiving unit 102 and the return auger receiving unit 103 comprises a part of the corresponding drum unit 38. That is, each drum unit 38 comprises a supply auger receiving unit 102 and a return auger receiving unit 103.

The supply auger receiving unit 102 and the return auger receiving unit 103 have hollow cylindrical shapes long in the width direction, and are supported by both side walls, in the width direction, of the frame 43. The supply auger 48 of the corresponding drum unit 38 is housed in the supply auger receiving unit 102. For example, the uppermost supply auger receiving unit 102 in the drawing receives the supply auger 48 of the yellow drum unit 38Y. Similarly, the return auger receiving unit 103 receives the return auger 49 of the corresponding drum unit 38. For example, the uppermost return auger receiving unit 103 in the drawing receives the return auger 49 of the yellow drum unit 38Y. Four coupling members 104 each opposite to each pair of the supply auger 102 and the return auger 103 across the right side wall of the frame 43 are provided on the right side surface of the frame 43. Each of the coupling members 104 comprises a part of the corresponding drum unit 38.

As shown in FIG. 7, the coupling member 104 has a parallelogram shape inclined obliquely rearward and upward when viewed from right side, and is thick in the width direction. The right side surface of the coupling member 104 extends along the up-down direction. A drum side supply port 105 as an example of a developing unit side reception port is formed at the rear upper end on the right surface of the coupling member 104, and a drum side return port 106 as an example of a developing unit side return port is formed at the front lower end, particularly at an obliquely front lower part of the drum side supply port 105. The opening surfaces of the drum side supply port 105 and the drum side return port 106 extend along the up-down direction. The drum side supply port 105 is rectangular and has almost the same size as the partition wall side supply port 95, and extends, as shown in FIG. 11A, leftward in the coupling member 104, and communicates with the right end of the corresponding supply auger receiving unit 102 from the upper side. As shown in FIG. 7, the drum side return port 106 is circular and has almost the same size as the partition wall side return port 96, passes through the coupling member 104 in the width direction, and communicates with the corresponding return auger receiving unit 103 from the right side. In the state in which the drum section 44 is mounted to the body casing 2, the drum side supply port 105 is opposite to the corresponding partition wall side supply port 95 in the partition wall 95 from the left and communicates therewith (see FIG. 11A). Similarly, the drum side return port 106 is opposite to the corresponding partition wall side return port 96 (see FIG. 11) in the partition wall 91 from the left, and communicates therewith. Thus, the body shutter 99 rotates between the open position and the closed position, and simultaneously opens and closes not only the partition wall side supply port 95, the partition wall side return port 96 and the waste toner discharge port 128 (see FIG. 2), but also the drum side supply port 105 and the drum side return port 106. Besides, in the drum section 44, a shaft of each of the photosensitive drums 37 exposed to the right is supported by a guide groove (not shown) provided in the partition wall 91 (see FIG. 11).

(3) Toner Cartridge

Figure 8A:
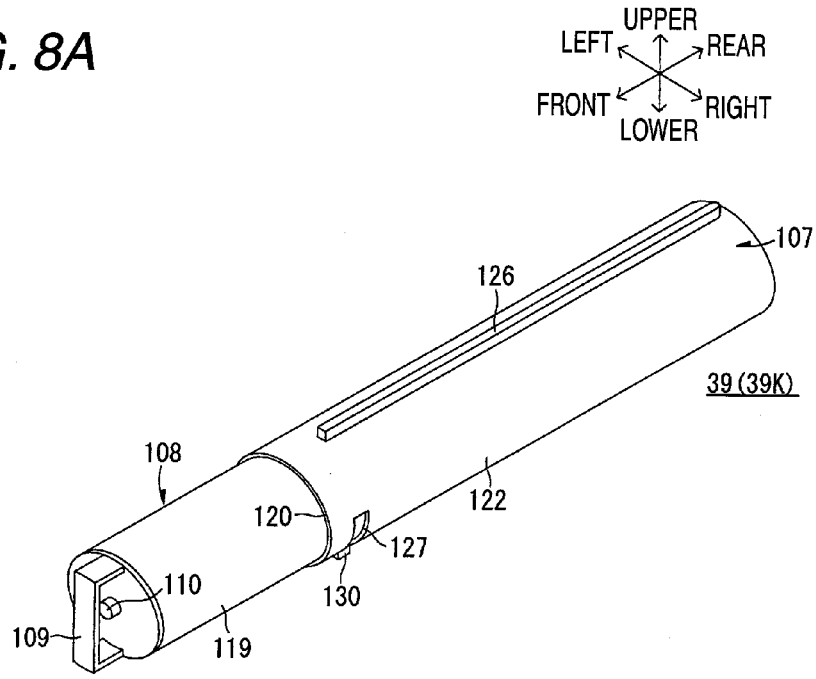
Figure 8B:
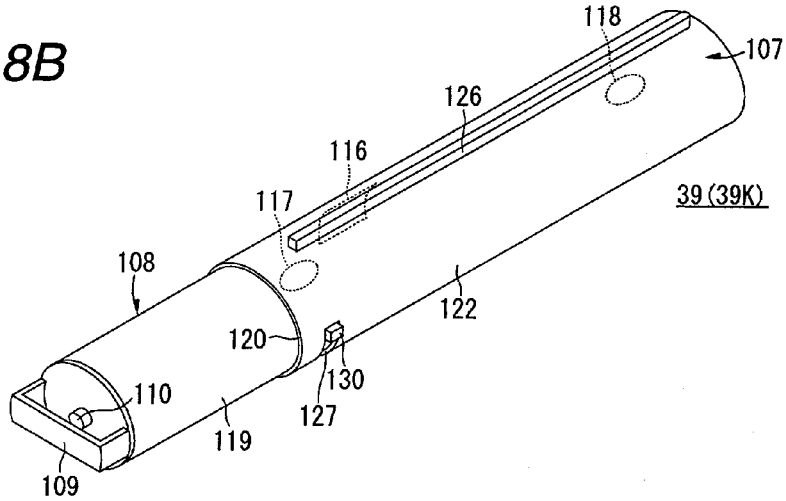

As shown in FIGS. 8A and 8B and as described above, the toner cartridge 39 has a cylindrical shape long in the front-rear direction. The toner cartridge 39 includes an outer cylinder 107 and an inner cylinder 108. As described later, the black toner cartridge 39K is longer, in the front-rear direction, than the other toner cartridge 39 and is different from the other toner cartridge 39 in that the waste toner containing unit 70 (see FIG. 10A) is provided. However, for convenience of description, a description will be made on the basis of the black toner cartridge 39K.

(3-1) Inner Cylinder

Figure 10A:
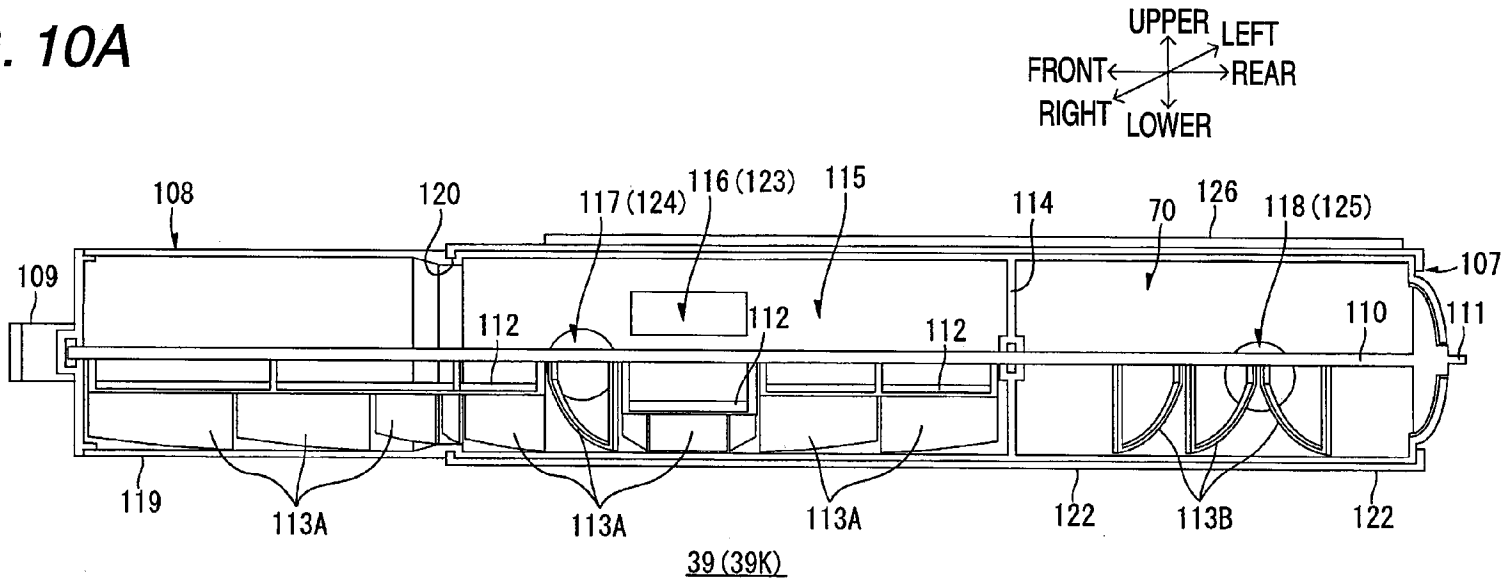

As show in FIG. 10A, the inner cylinder 108 is formed into a hollow cylindrical shape long in the front-rear direction. Both end surfaces of the inner cylinder 108 in the axial line direction (front-rear direction) are closed by side walls each having a circular shape when viewed from front. The front side wall of the inner cylinder 108 is formed to be flat along the vertical direction, and the rear side wall of the inner cylinder 108 is formed to be convex rearward. The substantially inversely U-shaped handle 109 (see FIGS. 8A and 8B) is integrally attached to the front side wall of the inner cylinder 108.

In more detail, the handle 109 passes the circle center of the front side wall of the inner cylinder 108, and is connected to the front side wall so that respective idle ends are opposite to each other across the circle center of the front side wall of the inner cylinder 108.

Figure 9A:
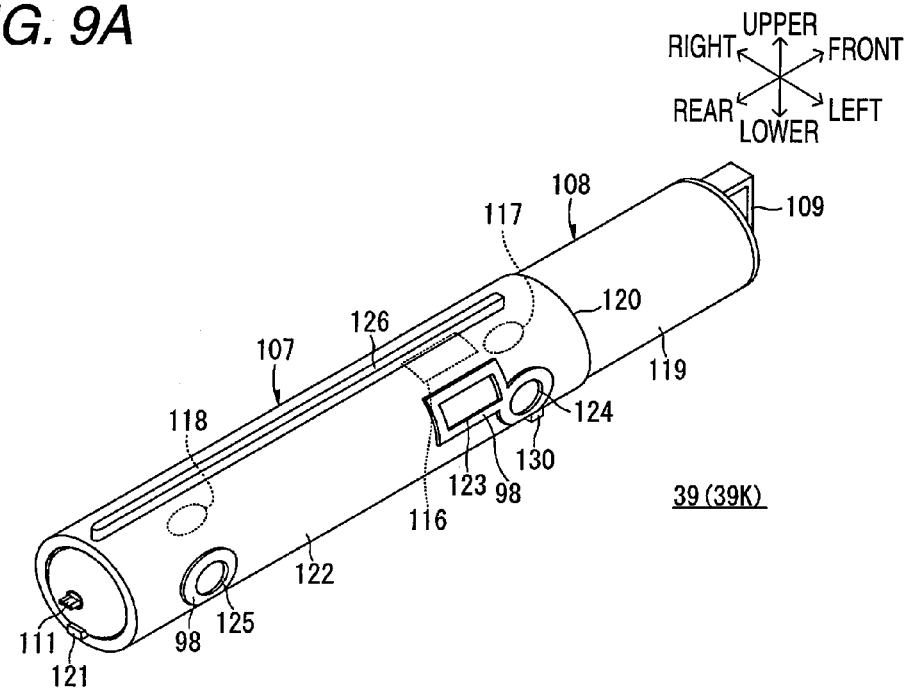
Figure 9B:
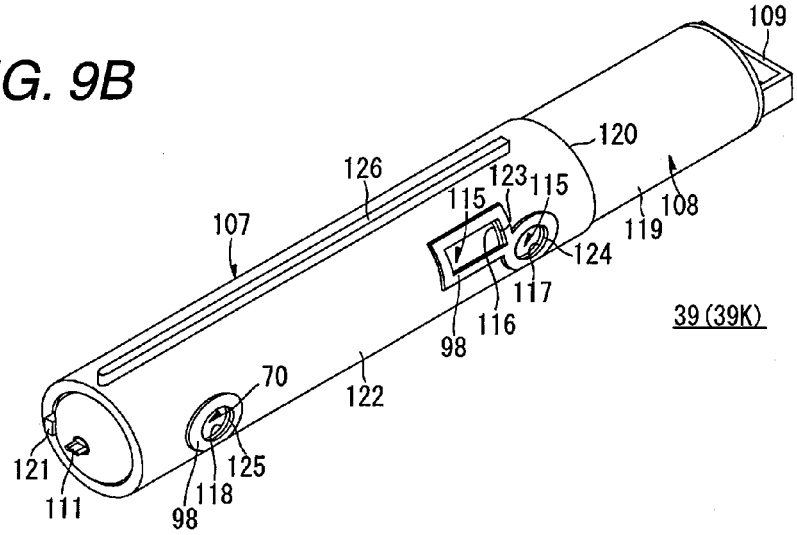
Figure 10B:
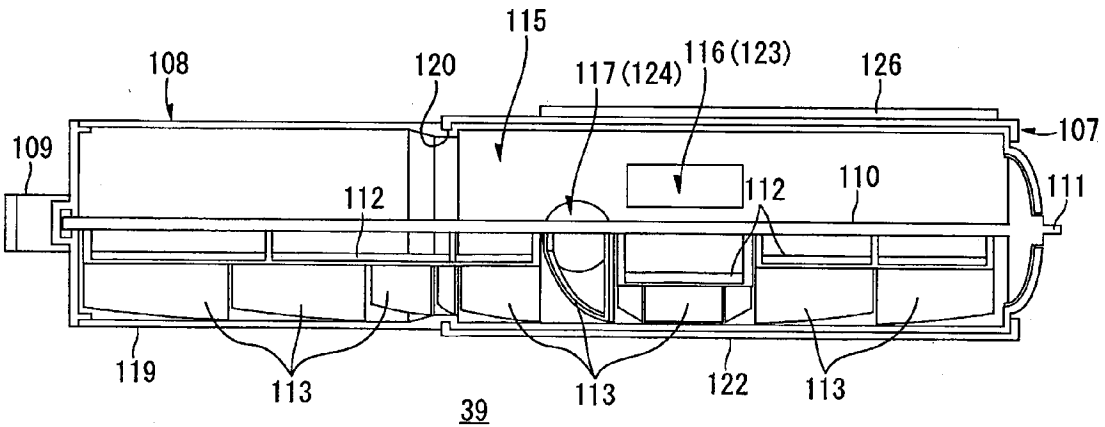

As shown in FIGS. 10A and 10B, the inner cylinder 108 is divided by a wall 114 positioned slightly behind the center in the front-rear direction into the new toner containing unit 115 in front of the wall 114 and the waste toner containing unit 70 behind the wall 114. That is, the new toner containing unit 115 and the waste toner containing unit 70 are disposed side by side in the front-rear direction. In the new toner cartridge 39, toner (sometimes called new toner to differentiate it from a waste toner) is contained in the new toner containing unit 115, and the waste toner containing unit 70 is empty. An agitator rotation shaft 110 that extends in the front-rear direction along the axial line of the inner cylinder 108 and is an example of a rotation shaft is provided in the inner cylinder 108. The agitator rotation shaft 110 passes through the wall 114, and is rotatably supported on both side walls, in the front-rear direction, of the inner cylinder 108. A driven projection 111 is provided at the rear end of the agitator rotation shaft 110. The driven projection 111 is formed into substantially the shape of a figure eight when viewed from the back (see FIGS. 9A and 9B), and is exposed toward the outside at a position behind the rear side wall of the inner cylinder 108. The agitator rotation shaft 110 includes an agitator support frame 112 spaced by an equal distance and extending in the front-rear direction at the outside in the radial direction. A plurality of agitators 113 are provided on the agitator support frame 112. In the new toner containing unit 115, each of the agitators 113 (for convenience of description, hereinafter called a front agitator 113A as an example of a second agitation member) is made of a flexible film or the like and is formed into a substantially rectangular shape, and the outside edge in the radial direction is formed to be inclined to the outside in the radial direction and toward a cartridge inside supply port 116 as an example of a cartridge side supply port described later and a cartridge inside return port 117 as an example of a cartridge side reception port described later. Among these front agitators 113A, the front agitator 113A opposite to a cartridge inside supply port 116 and a cartridge inside return port 117 (both described below) in the radial direction is different from the other front agitator 113A in structure. The front agitator 113A corresponding (disposed in the vicinity) to the cartridge inside supply port 116 is provided on the agitator support frame 112, and is formed into a substantially isosceles trapezoid shape tapering toward the outside in the radial direction. The front agitator 113A corresponding to the cartridge inside return port 117 is provided on the agitator rotation shaft 110, and is formed into a substantially triangular frame shape by a wire or the like. On the other hand, the agitator 113 (called a rear agitator 113B as an example of a first agitation member in order to differentiate the rear agitator 113B from the front agitator 113A) contained in the waste toner containing unit 70 is formed into a substantially triangular frame shape by a wire or the like, and in the vicinity of a waste toner inside reception port 118 as an example of a cartridge side opening described later, the outside edge in the radial direction is inclined to the outside in the radial direction and toward the direction of separating from the waste toner inside reception port 118. Both rotation shafts of the front agitator 113A and the rear agitator 113B are the agitator rotation shaft 110.

As shown in FIG. 9B, the cartridge inside supply port 116, the cartridge inside return port 117 and the waste toner inside reception port 118 are formed in the side surface (left side surface in FIG. 9B) of an inner cylinder peripheral wall 119 forming the peripheral surface of the inner cylinder 108. In more detail, the cartridge inside supply port 116 and the cartridge inside return port 117 are formed in the new toner containing unit 115, and the waste toner inside reception port 118 is formed in the waste toner containing unit 70. The waste toner inside reception port 118 is positioned at the rear end of the inner cylinder peripheral wall 119, and is a circular hole communicating with the inside of the waste toner containing unit 70. The waste toner inside reception port 118 has almost the same size as the waste toner discharge port 128 (see FIG. 2). The cartridge inside supply port 116 is positioned slightly before the center, in the front-rear direction, of the inner cylinder peripheral wall 119, and has a rectangular shape of almost the same size as the partition wall side supply port 95 (see FIGS. 11A and 11B). The cartridge inside return port 117 is adjacent to an obliquely front lower part of the cartridge inside supply port 116 on the basis of FIG. 9B, and has a circular shape of almost the same size as the partition wall side return port 96 (see FIGS. 11A and 11B). As described above, since the partition wall side supply port 95 is larger than the partition wall side return port 96, the cartridge inside supply port 116 is larger than the cartridge inside return port 117. Both the cartridge inside supply port 116 and the cartridge inside return port 117 communicate with the inside of the new toner containing unit 115.

As shown in FIG. 8B, in the inner cylinder peripheral wall 119, a radius-direction projection 130 projecting to the outside in the radial direction is provided in the vicinity of the opposite position of the cartridge inside return port 117 with respect to the circle center thereof.

As shown in FIGS. 10A and 10B, on the outer peripheral surface of the inner cylinder peripheral wall 119, an engagement groove 120 is formed at a position before the cartridge inside return port 117. The engagement groove 120 extends along the circumferential direction of the inner cylinder peripheral wall 119, and is formed into a circular shape. As shown in FIG. 9A, in the rear side wall of the inner cylinder 108, an axial direction projection 121 projecting rearward is provided substantially at the same peripheral direction position as the radius-direction projection 130.

(3-2) Outer Cylinder

The outer cylinder 107 is formed into a hollow and substantially cylindrical shape slightly larger than the inner cylinder 108, and both ends in the axial direction (front-rear direction) are opened.

As shown in FIGS. 10A and 10B, an outer cylinder peripheral wall 122, as an example of a cartridge side shutter, to form a peripheral surface of the outer cylinder 107 is formed in the front-rear direction to extend from the rear side wall of the inner cylinder 108 to the engagement groove 120.

As shown in FIG. 9B, a cartridge outside supply port 123, a cartridge outside return port 124, and a waste toner outside reception port 125 are formed on one side surface (left side surface in FIG. 9B) of the outer cylinder peripheral wall 122. The cartridge outside supply port 123, the cartridge outside return port 124, and the waste toner outside reception port 125 pass through the outer cylinder peripheral wall 122, and lower edges thereof are positioned above at least the lower edge of the inner peripheral surface of the outer cylinder peripheral wall 122. The waste toner outside reception port 125 is a circular hole of almost the same size as the waste toner inside reception port 118, and is positioned at the rear end of the outer cylinder peripheral wall 122. The cartridge outside supply port 123 is positioned at the front end of the outer cylinder peripheral wall 122, and has a rectangular shape of almost the same size as the partition wall side supply port 95 (see FIGS. 11A and 11B). As shown in FIG. 9B, the cartridge outside return port 124 is adjacent to a obliquely front lower part of the cartridge outside supply port 123, and has a circular shape of almost the same size as the partition wall side return port 96 (see FIGS. 11A and 11B). The second seal 98 is attached to the outside surface of the outer cylinder peripheral wall 122 so as to surround the periphery of the cartridge outside supply port 123, the cartridge outside return port 124, and the waste toner outside reception port 125. The second seal 98 is formed of the same material as the first seal 97.

On the outer cylinder peripheral wall 122, a radius-direction protrusion 126 projecting toward the outside in the radial direction is provided at a position shifted from the cartridge outside return port 124 by about 90 in the counterclockwise direction when viewed from back. The radius-direction protrusion 126 is provided to extend from the front end of the outer cylinder peripheral wall 122 to the rear end. As shown in FIG. 8B, on the outer cylinder peripheral wall 122, a projection reception groove 127 passing through the outer cylinder peripheral wall 122 in the radial direction is formed between a position shifted from the cartridge outside return port 124 by about 90 in the clockwise direction when viewed from back and a position shifted from the cartridge outside return port 124 by about 180 in the clockwise direction when viewed from back. The projection reception groove 127 is positioned in front of the front end of the radius-direction protrusion 126.

As shown in FIGS. 10A and 10B, the front edge and the rear edge of the outer cylinder peripheral wall 122 are bent toward the axial center over the whole circumference.

The outer cylinder 107 is attached to the inner cylinder 108 so that the outer cylinder peripheral wall 122 covers substantially the rear half portion of the outer peripheral surface of the inner cylinder peripheral wall 119. In more detail, the front edge of the outer cylinder peripheral wall 122 is engaged with the engagement groove 120 of the inner cylinder peripheral wall 119. The rear edge of the outer cylinder peripheral wall 122 is engaged with the peripheral edge of the rear side wall of the inner cylinder 108.

As shown in FIGS. 9A and 9B, the driven projection 111 and the axial direction projection 121 of the inner cylinder 108 are exposed rearward from the rear side opening portion of the outer cylinder 107. As shown in FIGS. 8A and 8B, the radius-direction projection 130 of the inner cylinder 108 is exposed at a forward side of the front end of the radius-direction protrusion 126 toward the outside in the radial direction from the projection reception groove 127 of the outer cylinder 107.

In the state in which the outer cylinder 107 is attached to the inner cylinder 108, the outer peripheral surface of the inner cylinder peripheral wall 119 slides on the inner peripheral surface of the outer cylinder peripheral wall 122 in the circumferential direction. In more detail, the inner cylinder 108 can be freely rotated with respect to the outer cylinder 107 between the closed position (see FIG. 8A, FIG. 9A and FIG. 11A) and the open position (see FIG. 8B, FIG. 9B and FIG. 11B). When the inner cylinder is at the closed position, as shown in FIG. 9A, the cartridge inside supply port 116, the cartridge inside return port 117 and the waste toner inside reception port 118 are closed from outside by the outer cylinder peripheral wall 122. The handle 109 is long in the up-down direction (see FIG. 8A). On the other hand, the position in which the inner cylinder 108 is rotated from the closed position of FIG. 9A by about 90 in the clockwise direction when viewed from back is the open position shown in FIG. 9B. When the inner cylinder 108 is at the open position, the cartridge inside supply port 116 and the cartridge outside supply port 123 are opposite in the radial direction of the inner cylinder 108 and communicates with each other. Similarly, the cartridge inside return port 117 and the cartridge outside return port 124 are opposite in the radial direction and communicate with each other, and the waste toner inside reception port 118 and the waste toner outside reception port 125 are opposite in the radial direction and communicate with each other. The handle 109 is long in the width direction (see FIG. 8B). As stated above, the inner cylinder 108 is rotated between the open position and the closed position, so that the cartridge inside supply port 116, the cartridge inside return port 117 and the waste toner inside reception port 118 are simultaneously opened and closed by the outer cylinder peripheral wall 122. Even if the inner cylinder 108 is located at a position between the open position and the closed position, the lower edges of the cartridge inside supply port 116, the cartridge inside return port 117 and the waste toner inside reception port 118 are positioned above the lower edge of the inner peripheral surface of the inner cylinder peripheral wall 119.

The radius-direction projection 130 of the inner cylinder 108 is moved in the projection reception groove 127 in accordance with the rotation of the inner cylinder 108. When the inner cylinder 108 is at the closed position, the radius-direction projection 130 comes in contact with the lower edge of the projection reception groove 127 and projects downward (see FIG. 8A). When the inner cylinder 108 is at the open position, the radius-direction projection 130 comes in contact with the upper edge of the projection reception groove 127 and projects rightward (see FIG. 8B).

As stated above, the black toner cartridge 39K (see FIG. 10A) includes the waste toner containing unit 70, while the other three toner cartridges 39 (see FIG. 10B) do not include the waste toner containing unit 70. Thus, as shown in FIGS. 10A and 10B, as compared with the other three toner cartridges 39, the black toner cartridge 39K projects rearward by the waste toner containing unit 70. The black cartridge receiving space 89K (see FIG. 5) also projects rearward as compared with the other cartridge receiving spaces 89.

Figure 6:
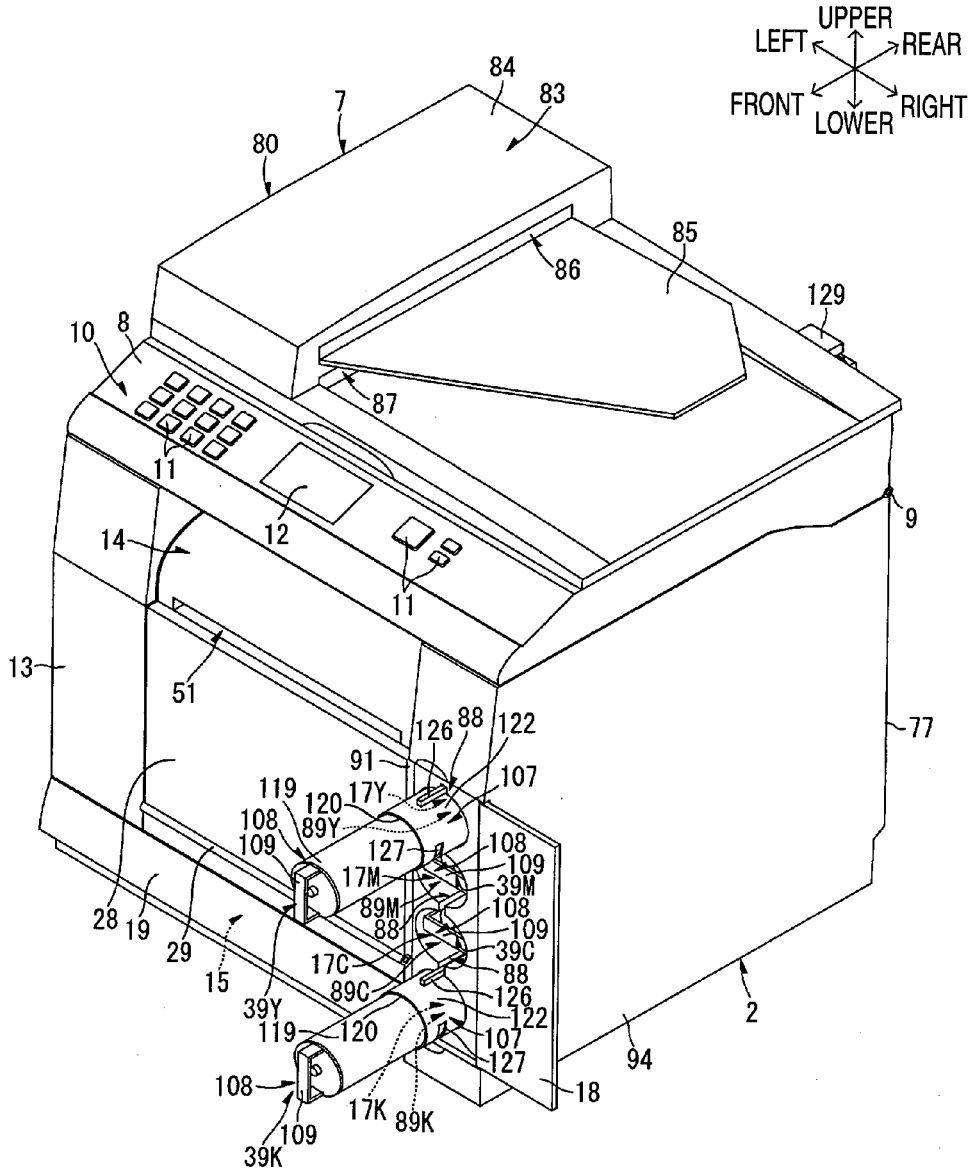
FIG. 6 is a view showing a state of the printer of FIG. 5 in which toner cartridges are attached to and detached from the main body casing of the printer.

(4) Attachment and Detachment of the Toner Cartridge to and from the Main Body Casing (4-1) Mounting of the Toner Cartridge to the Main Body Casing First, as shown in FIG. 6, the cartridge door 18 is rotated to the open position such that the cartridge attachment-detachment ports 17 are opened. The handle 109 of the toner cartridge 39 in which the inner cylinder 10 is at the closed position is grasped, and the toner cartridge 39 is inserted from the front side wall 13 side into the corresponding cartridge attachment-detachment port 17 while the horizontal posture is being kept. For example, if the cartridge is the black toner cartridge 39K, the cartridge is inserted into the black cartridge attachment-detachment port 17K.

The toner cartridge 39 is pressed into the cartridge receiving space 89 continuous with the cartridge attachment-detachment port 17 rearward. For example, if the cartridge is the black toner cartridge 39K, the cartridge is pressed into the black cartridge receiving space 89K. At this time, the radius-direction protrusion 126 is continuously received in the notch 88. That is, the radius-direction protrusion 126 is guided by the notch 88, and the toner cartridge 39 is moved rearward along the horizontal direction in the cartridge receiving space 89. When the front edge of the radius-direction protrusion 126 is also received by the notch 88, the radius-direction projection 130 (see FIG. 8A) projecting downward is received by the notch 88 of the lower end of the cartridge attachment-detachment port 17.

As shown in FIG. 11A, when the toner cartridge 39 is further pressed rearward, although not shown, the radius-direction protrusion 126 comes in contact with the rear edge of the notch 88 receiving the radius-direction protrusion 126. The radius-direction projection 130 is delivered from the notch 88 receiving the radius-direction projection 130 to the reception unit 132 (see FIG. 12A) of the body shutter 99 at the closed position, and the axial direction projection 121 (see FIG. 9) is fitted in the through-hole 133 (see FIG. 12A) of the body shutter 99. By this, the radius-direction projection 130 and the axial direction projection 121 (see FIG. 9) are engaged with the body shutter 99. The driven projection 111 (see FIGS. 9A and 9B) of the toner cartridge 39 passes through the insertion hole 134 (see FIG. 12A) of the body shutter 99, and is coupled to a drive mechanism (not shown) provided in the main body casing 2. By this, the toner cartridge 39 has been completely received in the cartridge receiving space 89. Here, when all the toner cartridges 39 are received in the corresponding cartridge receiving spaces 89, the lowermost black toner cartridge 39K is disposed closest to the waste toner discharge port 128, in more detail, at the right side (see FIG. 2).

When the toner cartridges 39 adjacent to each other in the up-down direction are received in the corresponding cartridge receiving spaces 89, the radius-direction projection 130 of the upper toner cartridge 39 and the radius-direction protrusion 126 of the lower toner cartridge 39 are received in the common notch 88. However, the notch 88 is formed to be relatively narrow so that the radius-direction projection 130 and the radius-direction protrusion 126 are not received simultaneously. Thus, even if the toner cartridges 39 adjacent to each other in the up-down direction are attempted to be simultaneously received in the cartridge receiving space 89, the radius-direction projection 130 of the upper toner cartridge 39 and the radius-direction projection 126 of the lower toner cartridge 39 to be received in the common notch 88 interfere with each other. Accordingly, one toner cartridge 39 is received in the cartridge receiving space 89 first and the inner cylinder 108 is rotated to the closed position, and then, the other toner cartridge 39 is inserted into an adjacent cartridge attachment-detachment port 17. Accordingly, it is possible to prevent the toner cartridge 39 from being received in an erroneous cartridge receiving space 89, i.e., a cartridge receiving space that does not correspond to the color of the toner cartridge. In other words, the radius-direction projections and the notches perform a keying function.

In the state in which the toner cartridge 39 has been completely received in the cartridge receiving space 89, as shown in FIG. 5, the handle 109 is grasped and is twisted to rotate the inner cylinder 108 from the closed position to the open position. The body shutter 99 in the state in which the body shutter 99 is engaged with the radius-direction projection 130 of the inner cylinder 108 and the axial direction projection 121 is rotated to the open position in accordance with the rotation of the inner cylinder 108 to the open position as shown in FIG. 11B and FIG. 12B.

By this, the cartridge inside supply port 116, the cartridge outside supply port 123, the partition wall side supply port 95 and the drum side supply port 105 are respectively opposite in the width direction and communicate with each other. The cartridge inside return port 117, the cartridge outside return port 124, the partition wall side return port 96 and the drum side return port 106 (see FIG. 7) are respectively opposite in the width direction and communicate with each other. Also, the waste toner inside reception port 118, the waste toner outside reception port 125, and the waste toner discharge port 128 are respectively opposite in the width direction and communicate with each other (see FIG. 2). Here, as shown in FIG. 4, when the cartridge door 18 is rotated to the closed position, the mounting of the toner cartridge 39 to the main body casing 2 is completed.

In this state, when the drive motor (not shown) of the main body casing 2 is driven, the drive force is transmitted from the drive mechanism (not shown) to the driven projection 111 (see FIG. 10A), and the driven projection 111 is rotated. In accordance with the rotation of the driven projection 111, as shown in FIG. 11B, the agitator rotation shaft 110 and the agitator 113 (the front agitator 113A and the rear agitator 113B) are rotated in the clockwise direction when viewed from front. By the rotation of the front agitator 113A, in the new toner containing unit 115, new toner is agitated and is supplied to the cartridge inside supply port 116. The new toner supplied to the cartridge inside supply port 116 passes through the cartridge outside supply port 123, the partition wall side supply port 95 and the drum side supply port 105 in sequence to the left side as indicated by an illustrated thick solid line arrow, drops at the drum side supply port 105, and is supplied to the supply auger 48. Then, as described above, the new toner is conveyed to the left by the supply auger 48 and is supplied to the supply roller 45. The new toner which has not been supplied to the supply roller 45 is conveyed to the right by the return auger 49 as described above, and as indicated by an illustrated thick broken line arrow, the unsupplied toner passes through the drum side return port 106 (see FIG. 7), the partition wall side return port 96, the cartridge outside return port 124 and the cartridge inside return port 117 in sequence to the right, and is returned to the new toner containing unit 115. The toner returned to the new toner containing unit 115 is again supplied to the cartridge inside supply port 116 by the front agitator 113A. Accordingly, the new toner circulates between the new toner containing unit 115 and the corresponding drum unit 38. Since the first seal 97 and the second seal 98 intervene between the outer cylinder 107 and the partition wall 91 (in more detail, the curved unit 93), at the time of circulation of the toner, it is possible to prevent the toner leakage between the partition wall side supply port 95 and the cartridge outside supply port 123 and the toner leakage between the partition wall side return port 96 and the cartridge outside return port 124.

The waste toner removed from the surface of the transfer belt 54 in the cleaning unit 33 and conveyed to the right by the discharge auger 68 passes through the waste toner discharge port 128, the waste toner outside reception port 125 and the waste toner inside reception port 118 in sequence as shown in FIG. 2, and is contained in the waste toner containing unit 70 provided in the black toner cartridge 39K. The waste toner contained in the waste toner containing unit 70 is agitated by the rotating rear agitator 113B and is conveyed in the direction of separating from the waste toner inside reception port 118.

(4-2) Separation of the Toner Cartridge from the Main Body Casing

On the other hand, in the case where the toner cartridge 39 is separated from the main body casing 2, conversely to the procedure at the time when the toner cartridge 39 is received in the cartridge receiving space 89, first, as shown in FIG. 5, the cartridge door 18 is rotated to the open position, and the cartridge attachment-detachment port 17 is opened. Then, the handle 109 is grasped and twisted, and when the inner cylinder at the open position is rotated to the closed position, as shown in FIG. 11A, the body shutter 99 is rotated to the closed position. Thereafter, as shown in FIG. 6, when the handle 109 is grasped and pulled forward, the toner cartridge 39 is separated from the main body casing 2.

As stated above, the toner cartridge 39 is mounted to the main body casing 2 along the front-rear direction through the corresponding cartridge attachment-detachment port 17. On the other hand, the drum section 44 (drum units 38) is attached to and detached from the main body casing 2 along the substantially vertical direction (see FIG. 3). That is, the attachment and detachment direction of the toner cartridge 39 with respect to the main body casing 2 is different from the attachment and detachment direction of the drum section 44 with respect to the main body casing 2. The toner cartridge 39 and the drum section 44 (drum units 38) are independently attached to and detached from the main body casing 2.

3. Operation and Effects

In the color laser printer 1, as shown in FIG. 2, the plurality of drum units 38 and the plurality of toner cartridges 39 are disposed in parallel along the substantially vertical direction in the main body casing 2. A color image can be formed by the drum units 38 and the toner cartridges 39.

Here, as shown in FIG. 11B, the toner cartridge 39 is disposed to be opposite to the end (right end), in the width direction, of the drum unit 38 along the substantially horizontal direction. Further, the cartridge inside supply port 116 of the toner cartridge 39 and the drum side supply port 105 of the drum unit 38 are disposed to be opposite to each other along the substantially horizontal direction. That is, in the drum unit 38 and the toner cartridge 39 mounted to the main body casing 2, there is no overlapping portion.

Thus, in the case where, in the state in which one of the drum unit 38 and the toner cartridge 39 is mounted to the main body casing 2, the other is singly attached to or detached from the main body casing 2, it is possible to prevent the toner cartridge 39 and the drum unit 38 from being caught by each other. Accordingly, as compared with the case where the cartridge inside supply port 116 and the drum side supply port 105 are disposed to be opposite to each other along the substantially vertical direction, it is possible to prevent toner from leaking from the cartridge inside supply port 116 and the drum side supply port 105. Since a time when the toner cartridge 39 is separated from the main body casing 2 is the time of exchange, the amount of toner in the inside of the toner cartridge 39 has been decreased. Thus, the level of the toner is located at the position lower than the cartridge inside supply port 116 provided above the lower edge of the toner cartridge 39, and the leakage of the toner from the cartridge inside supply port 116 can be prevented.

As a result, the drum units 38 and the toner cartridge 39 can each be attached to and detached from the main body casing alone without leakage of toner.

The partition wall 91 that partitions the space of the main body casing 2 into the drum receiving space 90 and the cartridge receiving space 89 supports the photosensitive drum 37 in the drum receiving space 90, and attachably and detachably supports the toner cartridge 39 in the cartridge receiving space 89. Thus, the drum units 38 and the toner cartridge 39 mounted to the main body casing 2 can be accurately positioned.

Since the partition wall 91 is provided with the plurality of partition wall side openings 95 opposite to the respective cartridge inside supply ports 116 and the respective drum side supply ports 105, toner can be made to smoothly pass between the cartridge inside supply port 116 and the drum side supply port 105.

The toner received by the drum side supply port 105 can be smoothly supplied to the developing roller 46 by the supply auger 48 provided in the drum unit 38.

Among toners conveyed by the supply auger 48, the toner which has not been supplied to the developing roller 46 is received by the cartridge inside return port 117 of the toner cartridge 39 from the drum side return port 106 (see FIG. 7) of the drum unit 38 through the partition wall side return port 96 of the partition wall, and is returned to the toner cartridge 39. By this, the toner can be circulated between the toner cartridge 39 and the drum unit 38. Here, since the toner cartridge 39 is disposed to be opposite to the drum unit 38 along the substantially horizontal direction, there is little difference in height between the toner cartridge 39 and the drum unit 38. Thus, when the toner is circulated between the toner cartridge 39 and the drum unit 38, the toner can be easily conveyed without opposing gravity.

As shown in FIG. 10B, the cartridge inside supply port 116 is larger than the cartridge inside return port 117. Thus, the amount of toner supplied from the cartridge inside supply port 116 to the developing roller 46 can be made larger than the amount of toner returned from the cartridge inside return port 117 to the toner cartridge 39, and the toner density inside the drum unit 38 is raised, and consequently, continuous formation of toner images by the developing roller 46 can be maintained. By this, the quality of image formation can be improved, and the circulation of toner between the toner cartridge 39 and the drum unit 38 can be kept.

As shown in FIG. 3 and FIG. 6, since the attachment and detachment direction of the drum units 38 with respect to the main body casing 2 is different from the attachment and detachment direction of the toner cartridge 39 with respect to the main body casing 2, the attachment and detachment paths of the drum units 38 and the toner cartridge 39 with respect to the main body casing 2 can be freely set.

Since the drum units 38 are attached to and detached from the main body casing 2 along the substantially vertical direction, the drum units 38 can be smoothly mounted to the main body casing 2 by using the weight of the drum units 38 themselves.

Although the toner cartridge 39 is attached to and detached from the main body casing 2 from the front side wall 13 side of the main body casing 2, since the toner cartridge 39 extends to the front side wall 13 as shown in FIG. 2, it is possible to easily access the toner cartridge 39 from the front side wall 13 side. Additionally, since the toner cartridge 39 is extended to the front side wall 13 (the toner cartridge 39 is made long in the front-rear direction), the capacity of toner contained in the inside of the toner cartridge 39 can be set large.

As shown in FIGS. 10A and 10B, in the toner cartridge 39, since the cartridge inside supply port 116 is formed above the lower edge thereof, it is possible to prevent the toner contained in the toner cartridge 39 from leaking and dropping from the cartridge inside supply port 116.

4. Modified Example

In the above exemplary embodiment, as shown in FIG. 2, although the intermediate transfer type color laser printer 1 has been exemplified in which the toner images of the respective colors are once transferred from the respective photosensitive drums 37 to the transfer belt 54, and then, the toner images are collectively transferred onto the sheet 3, the invention is not limited to this, and for example, the inventive concept can be constructed as a direct transfer type color laser printer in which toner images of the respective colors are directly transferred onto the sheet 3 from the respective photosensitive drums 37.

In the above exemplary embodiment, although the toner remaining on the transfer belt 54 is contained as the waste toner in the waste toner containing unit 70, the toner remaining on the photosensitive drum 37 may be contained in the waste toner containing unit 70. In that case, the toner remaining on the photosensitive drum 37 is collected by, for example, the foregoing cleaning roller 42 (see FIG. 1), and is conveyed to the waste toner containing unit 70.

The transfer unit 32 and the cleaning unit 33 may be united or may be separated.

Further, in the scanner unit 30, although the photosensitive drum 37 is exposed by the laser beam emitted from the polygon mirror 35 shown in FIG. 1, instead of this, a light exposure unit may be used in which an exposure light source includes light-emitting elements including LEDs or the like and disposed in an array.

While the present invention has been shown and described with reference to certain exemplary embodiments thereof, it will be understood by those skilled in the art that various changes in form and details may be made therein without departing from the spirit and scope of the invention as defined by the appended claims.

According to a first aspect of the invention, there is provided an image forming apparatus comprising a housing; a plurality of developing units which are disposed in parallel along a substantially vertical direction in the housing, each of the developing units comprising: an image carrier on which an electrostatic latent image is formed, a developer carrier which carries a developer for supplying the developer to the image carrier and visualizing the electrostatic latent image to form a developer image, and a developing unit side reception port for receiving the developer; and a plurality of developer cartridges which correspond to the plurality of developing units, each of the developer cartridges containing the developer to be supplied to a respective one of the plurality of the developer carriers, the developer cartridges being disposed in parallel along the substantially vertical direction in the housing, each of developer cartridges comprising: a cartridge side supply port through which the developer passes to the respective developer carrier; wherein the developing units and the developer cartridges can be independently attached to and detached from the housing, each of the developer cartridges are disposed to be opposite to an end of a respective one of the developing units along a substantially horizontal direction in a longitudinal direction of the developer carrier, and wherein the cartridge side supply port and the developing unit side reception port are disposed to be opposite to each other along the substantially horizontal direction.

Besides, according to a second aspect of the invention, the image forming apparatus, further comprising a partition wall which is provided along the substantially vertical direction in the housing, the partition wall partitioning a space of the housing into a first space in which the developing units are disposed and a second space in which the developer cartridges are disposed, the partition wall supporting the image carrier in the first space, the partition wall attachably and detachably supporting the developer cartridges in the second space, and wherein the partition wall includes a plurality of first partition wall openings opposite to the respective cartridge side supply ports and the respective developing unit side reception ports.

Besides, according to a third aspect of the invention, the developing unit includes a conveying member that extends in parallel to the developer carrier and in a direction substantially orthogonal to an opening plane of the developing unit side reception port, and conveys the developer received by the developing unit side reception port to the developer carrier.

Besides, according to a fourth aspect of the invention, each of the developing units comprises a developing unit side return port for returning developer conveyed by the conveying member to the developer cartridge, the partition wall comprises a plurality of second partition wall openings opposite to the respective developing unit side return ports, the second partition wall openings provided for allowing the developer having passed through the respective developing unit side return ports to pass through, and each of the developer cartridges comprises a cartridge side reception port opposite to the second partition wall openings, the cartridge side reception port receiving the developer having passed through the second partition wall openings.

Besides, according to a fifth aspect of the invention, the cartridge side supply port is larger than the cartridge side reception port.

Besides, according to a sixth aspect of the invention, an attachment and detachment direction of the developing units with respect to the housing is different from an attachment and detachment direction of the developer cartridges with respect to the housing.

Besides, according to a seventh aspect of the invention, the developing units are attached to and detached from the housing along the substantially vertical direction.

Besides, according to a eighth aspect of the invention, the housing comprises a first side wall substantially parallel to the longitudinal direction of the developer carrier and a second side wall opposite to the first side wall across the respective developer cartridges, and each of the developer cartridges extends to the first side wall, and is attached to and detached from the housing from the first side wall side.

Besides, according to a ninth aspect of the invention, an image forming apparatus comprising: a housing; a partition wall which is provided in the housing along a substantially vertical direction, the partition wall partitioning the housing into a first space and a second space; a plurality of developing units which are disposed in parallel along the substantially vertical direction in the first space, each of the developing units comprising: an image carrier which is supported by the partition wall and on which an electrostatic latent image is formed, and a developer carrier which carries a developer for supplying the developer to the image carrier and visualizing an electrostatic latent image to form a developer image; and a plurality of developer cartridges which correspond to the plurality of developing units, the developer cartridges containing the developer to be supplied to respective ones of the developer carriers, the developer cartridges being disposed in parallel along the substantially vertical direction in the second space, wherein each of the developer cartridges comprises a cartridge side supply port, which is disposed above a lower edge thereof, for allowing passage of the developer supplied to the developer carrier.

Besides, according to a tenth aspect of the invention, an image forming apparatus comprising a housing; a partition wall which is provided in the housing along a substantially vertical direction, the partition wall partitioning the housing into a first space and a second space; a plurality of developing units which are disposed in parallel along the substantially vertical direction in the first space, each of the developing units comprising a reception port and a return port; and a plurality of developer cartridges which correspond to the plurality of developing units, the developer cartridges being disposed in parallel along the substantially vertical direction in the second space, each of developer cartridges comprising a supply port and a reception port, wherein the reception ports of the developing units communicate with the supply ports of respective ones of the developer cartridges, and the return ports of the developer units communicate with the reception ports of respective ones of the developer cartridges.

According to the invention of the first aspect, in the image forming apparatus, the plurality of developing units and the developer cartridges are disposed in parallel along the substantially vertical direction in the housing, and the color image can be formed by the developing units and the developer cartridges.

Here, the developer cartridge is disposed to be opposite to the end, in the longitudinal direction of the developer carrier, of the developing unit along the substantially horizontal direction. Further, the cartridge side supply port formed in the developer cartridge and for allowing passage of the developer supplied to the developer carrier and the developing unit side reception port formed in the developing unit and for receiving the developer having passed through the cartridge side supply port are disposed to be opposite to each other along the substantially horizontal direction. That is, there is no overlapping portion in the developing unit and the developer cartridge mounted to the housing.

Thus, in the case where one of the developing unit and the developer cartridge is mounted to the housing and the other is singly attached to or detached from the housing, it is possible to prevent the developer cartridge and the developing unit from being caught by each other. Besides, for example, as compared with the case where the cartridge side supply port and the developing unit side reception port are disposed to be opposite to each other along the substantially vertical direction, it is possible to prevent the developer from leaking from the cartridge side supply port and the developing unit side reception port.

As a result, the developing unit and the developer cartridge can be singly attached to and detached from the housing without leakage of the developer.

According to the invention of the second aspect, the partition wall that partitions the space of the housing into the first space where the developing units are disposed and the second space where the developer cartridges are disposed supports the image carrier in the first space, and attachably and detachably supports the developer cartridge in the second space, and therefore, the developing unit and the developer cartridge mounted to the housing can be accurately positioned.

Besides, since the partition wall includes the plurality of first partition wall openings opposite to the respective cartridge side supply ports and the respective developing unit side reception ports, the developer can be made to smoothly pass between the cartridge side supply port and the developing unit side reception port.

According to the invention of the third aspect, the developer received by the developing unit side reception port can be smoothly supplied to the developer carrier by the conveying member provided in the developing unit.

According to the invention of the fourth aspect, among developers conveyed by the conveying member, the developer which has not been supplied to the developer carrier is received from the developing unit side return port of the developing unit by the cartridge side reception port of the developer cartridge through the second partition wall opening of the partition wall, and is returned to the developer cartridge. By this, the developer can be circulated between the developer cartridge and the developing unit. Here, since the developer cartridge is disposed to be opposite to the developing unit along the substantially horizontal direction, there is little difference in height between the developer cartridge and the developing unit. Thus, when the developer is circulated between the developer cartridge and the developing unit, the developer can be easily conveyed without opposing the gravity.

According to the invention of the fifth aspect, since the cartridge side supply port is larger than the cartridge side reception port, the amount of developer supplied from the cartridge side supply port to the developer carrier can be made larger than the amount of developer returned from the cartridge side reception port to the developer cartridge, the amount of developer supplied to the developer carrier can be ensured, and continuous formation of developer images by the developer carrier can be kept. By this, the quality of the image formation can be improved, and the circulation of the developer between the developer cartridge and the developing unit can be kept.

According to the invention of the sixth aspect, since the attachment and detachment direction of the developing unit with respect to the housing is different from the attachment and detachment direction of the developer cartridge with respect to the housing, the attachment and detachment paths of the developing unit and the developer cartridge with respect to the housing can be respectively freely set.

According to the invention of the seventh aspect, since the developing unit is attached to and detached from the housing along the substantially vertical direction, the developing unit can be smoothly mounted to the housing by using the weight of the developing unit itself.

According to the invention of the eighth aspect, although the developer cartridge is attached to and detached from the housing from the first side wall side of the housing, since the developer cartridge extends to the first side wall, access can be easily made from the first side wall side to the developer cartridge. Besides, when the developer cartridge is extended to the first side wall, the capacity of the developer contained in the inside of the developer cartridge can be set large.

According to the invention of the ninth aspect, in the image forming apparatus, the plurality of developing units and the plurality of developer cartridges are disposed in parallel along the substantially vertical direction in the housing, and the color image can be formed by the developing units and the developer cartridges.

Besides, the partition wall that partitions the space of the housing into the first space where the developing units are disposed and the second space where the developer cartridges are disposed can support the image carrier in the first space and the developer cartridge in the second space, and therefore, the developing unit and the developer cartridge can be accurately positioned in the housing.

In the developer cartridge, since the cartridge side supply port for allowing passage of the developer supplied to the developer carrier is formed above the lower edge thereof, it is possible to prevent the developer contained in the developer cartridge from leaking and dropping from the cartridge side supply port. In particular, since the time when the developer cartridge is detached from the housing is the time of exchange, the amount of developer in the inside of the developer cartridge has been decreased. Thus, the level of the developer is located at the position lower than the cartridge side supply port provided above the lower edge of the developer cartridge, and the leakage of the developer from the cartridge side supply port can be prevented without fail.

What is claimed is:

1. An image forming apparatus comprising:

a photosensitive drum having an axis extending in a first direction;

a developer carrier disposed in parallel with the photosensitive drum and configured to supply toner to the photosensitive drum;

a belt;

a collecting member configured to collect waste toner on a surface of the belt and disposed at an opposite side to the developer carrier with respect to the photosensitive drum in a second direction orthogonal to the first direction, wherein the belt is disposed between the collecting member and the photosensitive drum; and a toner cartridge disposed at one side of the photosensitive drum in the first direction, the toner cartridge comprising:

a first containing unit disposed to be overlapped with the developer carrier when viewed in the first direction and configured to contain toner to be supplied to the developer carrier; and a second containing unit disposed to be overlapped with the collecting member and the belt when viewed in the first direction and configured to contain waste toner collected by the collecting member.

2. The image forming apparatus according to claim 1, wherein the collecting member is configured to contact a surface of the belt to collect waste toner.

3. The image forming apparatus according to claim 1, wherein the toner cartridge is disposed outside of an end face of the photosensitive drum at the one side in the first direction.

4. The image forming apparatus according to claim 1, further comprising:

a developing unit comprising the photosensitive drum and the developer carrier, wherein the toner cartridge comprises a cartridge side supply opening for supplying toner to the developer carrier, and the developing unit comprises a developing unit side reception opening disposed to oppose the cartridge side supply opening in the first direction.

5. The image forming apparatus according to claim 4, further comprising:

a housing; and a partition wall which is provided along a substantially vertical direction in the housing, the partition wall partitioning an inner space of the housing into a first space configured to receive the developing unit and a second space configured to receive the toner cartridge, the partition wall being configured to support the photosensitive drum in the first space and attachably and detachably support the toner cartridge in the second space, wherein the partition wall comprises a first partition wall opening opposing the cartridge side supply opening and the developing unit side reception opening.

6. The image forming apparatus according to claim 5, wherein the developing unit further comprises a conveying member extending in the first direction, which is substantially orthogonal to an opening plane of the developing unit side reception opening, and the conveying member is configured to convey toner received through the developing unit side reception opening to the developer carrier.

7. The image forming apparatus according to claim 6, wherein the developing unit comprises a developing unit side return opening for returning toner conveyed by the conveying member to the toner cartridge, wherein the partition wall comprises a second partition wall opening opposing the developing unit side return opening, the second partition wall opening being configured to allow toner having passed through the developing unit side return opening to pass therethrough, and wherein the toner cartridge further comprises a cartridge side reception opening opposing the second partition wall opening, the cartridge side reception opening being configured to receive toner having passed through the second partition wall opening.

8. The image forming apparatus according to claim 7, wherein the cartridge side supply opening is larger than the cartridge side reception opening.

9. The image forming apparatus according to claim 1, further comprising:

a housing; and a developing unit comprising the photosensitive drum and the developer carrier, wherein an attachment and detachment direction of the developing unit with respect to the housing is different from an attachment and detachment direction of the toner cartridge with respect to the housing.

10. The image forming apparatus according to claim 9, wherein the developing unit is configured to be attached to and detached from the housing along a substantially vertical direction.

11. The image forming apparatus according to claim 1, further comprising:

a housing comprising a first side wall substantially parallel to the first direction and a second side wall opposite to the first side wall across the toner cartridge, wherein the toner cartridge extends to the first side wall, and is configured to be attached to and detached from the housing from a side of the first side wall.

* * * * *